US011207722B2

(12) United States Patent
Ford et al.

(10) Patent No.: US 11,207,722 B2
(45) Date of Patent: Dec. 28, 2021

(54) SYSTEMS AND METHODS FOR MANUFACTURING A RING FROM A METAL SHEET

(71) Applicant: Amsted Rail Company, Inc., Chicago, IL (US)

(72) Inventors: Brian Ford, Mosely, VA (US); James Myers, Chesterfield, VA (US); Edgar Hernandez, Chesterfield, VA (US)

(73) Assignee: Amsted Rail Company, Inc., Chicago, IL (US)

( * ) Notice: Subject to any disclaimer, the term of this patent is extended or adjusted under 35 U.S.C. 154(b) by 222 days.

(21) Appl. No.: 16/126,550

(22) Filed: Sep. 10, 2018

(65) Prior Publication Data

US 2020/0078843 A1 Mar. 12, 2020

(51) Int. Cl.
*B21C 37/08* (2006.01)
*B21D 22/02* (2006.01)
(Continued)

(52) U.S. Cl.
CPC ..... *B21C 37/0815* (2013.01); *B21D 22/025* (2013.01); *B21D 31/005* (2013.01);
(Continued)

(58) Field of Classification Search
CPC ..... B21D 5/015; B21D 53/18; B21D 39/02; B21D 31/005; B21D 53/16; B21D 5/01;
(Continued)

(56) References Cited

U.S. PATENT DOCUMENTS 1,879,077 A * 9/1932 Carlsen ..... B21C 37/0822 72/368
1,879,078 A * 9/1932 Carlsen ..... B21C 37/0822 72/368

(Continued)

FOREIGN PATENT DOCUMENTS

JP 60130419 A * 7/1985 ..... B21D 5/01
JP 01018524 A * 1/1989

OTHER PUBLICATIONS

Kevin Caron, How to Roll Your Own Pipe—Kevin Caron, Feb. 13, 2013, Youtube, https://www.youtube.com/watch?v=O6dSihaHW_M (Year: 2013).*

*Primary Examiner* — Debra M Sullivan
*Assistant Examiner* — Dylan Schommer
(74) *Attorney, Agent, or Firm* — Lathrop GPM LLP

(57) ABSTRACT

A method for manufacturing a ring includes clamping a first region of a metal sheet against a mandrel, and, while the first region of the metal sheet is clamped against the mandrel, bending the metal sheet around the mandrel to join opposite end faces of the metal sheet and form the ring shaped to the mandrel. A system for manufacturing a ring from a metal sheet includes (a) a mandrel having a ring-shaped surface, (b) a clamp facing the ring-shaped surface and configured to clamp a first region of a metal sheet to the mandrel, and (c) a plurality of dies configured to bend the metal sheet around the mandrel, while the clamp clamps the first region to the mandrel, to join opposite end faces of the metal sheet and form a ring shaped to the ring-shaped surface.

20 Claims, 12 Drawing Sheets

(51) Int. Cl.
*B21D 51/10* (2006.01)
*B21D 53/16* (2006.01)
*B21D 31/00* (2006.01)
*B21D 11/20* (2006.01)

(52) U.S. Cl.
CPC ..... *B21D 51/10* (2013.01); *B21D 53/16* (2013.01); *B21D 11/203* (2013.01)

(58) Field of Classification Search
CPC ..... B21D 11/203; B21D 5/10; B21D 5/12; B21C 37/08; B21C 37/0803; B21C 37/02; B21C 37/06; B21C 37/0815
USPC ..... 72/51
See application file for complete search history.

(56) References Cited

U.S. PATENT DOCUMENTS 2,193,661 A * 3/1940 Young ..... B21F 37/02 411/531
2,505,718 A * 4/1950 Nowak ..... B21D 5/015 72/396
2,943,179 A * 6/1960 Raiha ..... B23K 11/0873 219/61.11
3,606,787 A * 9/1971 Umehara ..... B21D 51/10 72/337
7,350,386 B2 * 4/2008 Streubel ..... B21C 37/0815 219/61
8,459,076 B2 * 6/2013 Flehmig ..... B21C 37/155 72/48
8,959,973 B2 * 2/2015 Bro ..... B21D 5/015 72/368
2006/0150388 A1 * 7/2006 Inada ..... B23K 11/084 29/516
2006/0236737 A1 * 10/2006 Shitamoto ..... B21C 37/08 72/51
2015/0129556 A1 * 5/2015 Grosseruschkamp ..... B23K 26/262 219/61
2017/0247122 A1 * 8/2017 Hunt ..... B23P 19/10
2017/0326609 A1 * 11/2017 Alberini ..... B21D 5/12

* cited by examiner

SYSTEMS AND METHODS FOR MANUFACTURING A RING FROM A METAL SHEET

BACKGROUND

A variety of metal forming techniques are used to form metal rings. Metal rings with thin walls may be formed using roll forming, wherein a thin metal strip is roll-formed into a ring that joins the two opposite ends of the metal strip. After welding of the joint between the two opposite ends, the ring shape may be perfected by expanding a die against the inside wall of the ring. Thicker rings may be formed using hot forging. In one hot forging example, a hole is punched in a thick metal stock, whereafter the diameter of the hole is gradually expanded with rollers in a hot forging process. Alternatively, thick rings may be formed by repeatedly passing a straight metal rod between a set of rollers that, for each pass, bend the metal rod further until the ends of the rod overlap. Next, the overlap is trimmed and the ends are joined to complete the ring.

SUMMARY

In an embodiment, a method for manufacturing a ring from a metal sheet includes (a) clamping a first region of the metal sheet against a mandrel, and (b) while the first region of the metal sheet is clamped against the mandrel, bending the metal sheet around the mandrel to join a first end face of the metal sheet to a second end face of the metal sheet and form the ring shaped to the mandrel.

In an embodiment, a system for manufacturing a ring from a metal sheet includes (a) a mandrel having a ring-shaped surface, (b) a clamp facing the ring-shaped surface and configured to clamp a first region of a metal sheet to the mandrel, and (c) a plurality of dies configured to bend the metal sheet around the mandrel, while the clamp clamps the first region to the mandrel, to join a first end face to a second end face of the metal sheet and form a ring shaped to the ring-shaped surface.

In an embodiment, a metal ring includes a wall made of metal and having thickness in range between 0.125 inches and 1.0 inches. A cross section of the wall in a first plane is a closed shape. The wall has a minimum radius of curvature no greater than 15 inches. The wall includes a weld joint joining together two opposite end faces of a metal sheet from which the side wall is formed.

BRIEF DESCRIPTION OF THE DRAWINGS

FIGS. 8-12 together illustrate a method for manufacturing a cylindrical ring from a metal sheet, using the system of FIG. 8, according to an embodiment.

FIGS. 14-16 together illustrate a method for manufacturing a ring having a rectangular profile, using the system of FIG. 14, according to an embodiment.

FIGS. 17-21 together illustrate a method for manufacturing a ring having a triangular profile, using the system of FIG. 17, according to an embodiment.

FIGS. 22-25 together illustrate a method for manufacturing a ring having a profile shaped as a parallelogram, using the system of FIG. 22, according to an embodiment.

DETAILED DESCRIPTION OF THE EMBODIMENTS

Figure 1:
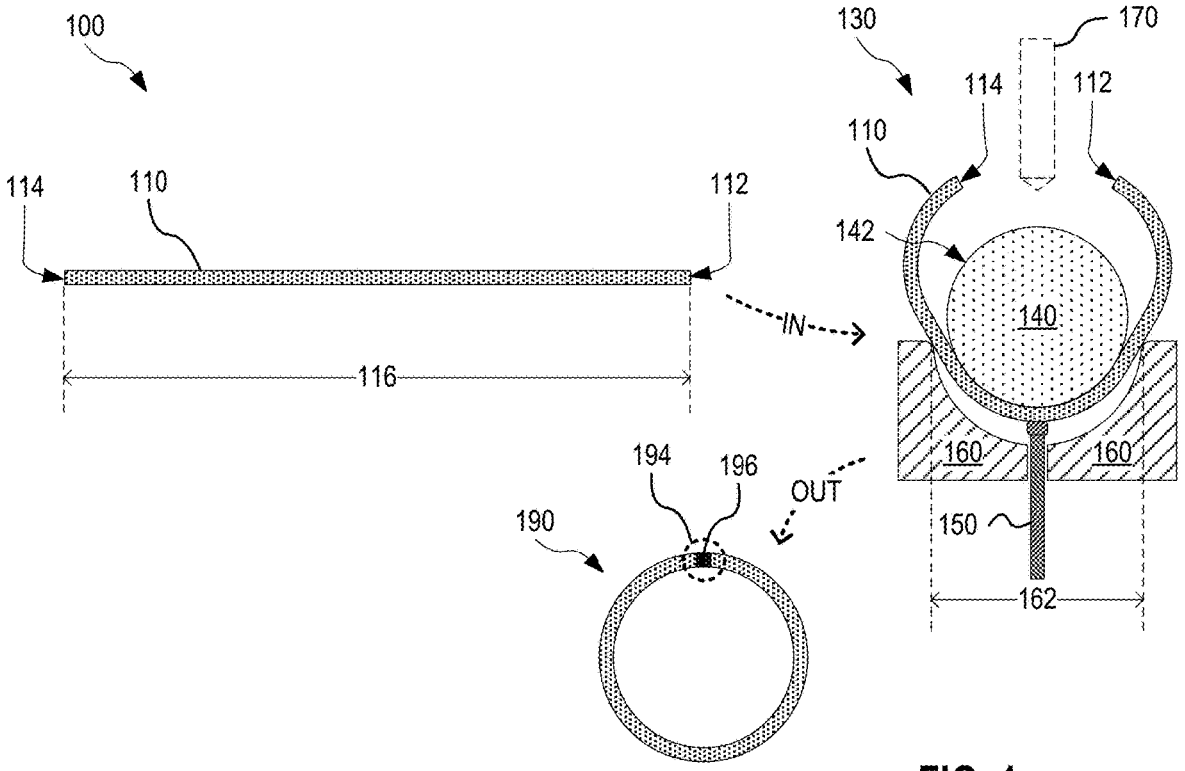
FIG. 1 illustrates a method for manufacturing a ring from a metal sheet, according to an embodiment.

FIG. 1 illustrates, in cross-sectional side view, one method 100 for manufacturing a ring from a metal sheet. Method 100 feeds a metal sheet 110 into a ring manufacturing system 130 that bends metal sheet 110 into a ring 190. Metal sheet 110 may be substantially planar prior to bending by system 130. System 130 includes a mandrel 140, a clamp 150, and a plurality of dies 160. It is understood that the shapes of mandrel 140, clamp 150, and dies 160 may deviate from those depicted in FIG. 1, and that system 130 may be configured with more and/or other dies 160 than those depicted in FIG. 1. In method 100, clamp 150 clamps metal sheet 110 to mandrel 140. While metal sheet 110 is clamped to mandrel 140, mandrel 140 and dies 160 cooperate to bend metal sheet 110 around mandrel 140 to join opposite end faces 112 and 114 of metal sheet 110 to each other, so as to form a ring 190 according to the shape of ring-shaped surface 142 of mandrel 140.

Although FIG. 1 shows ring 190 as having circular cross section, the cross section of ring 190 may have a different shape, such as oval, triangular, rectangular, square, trapezoidal, polygonal, or a combination thereof, without departing from the scope hereof. Herein, the term "ring" refers to a wall having a shape that encloses a space, such that there is a plane wherein the cross section of the wall is a closed shape For example, any shape resulting from bending of metal sheet 110 to join end faces 112 and 114 to each other, such that end faces 112 and 114 face each other, is considered a "ring".

In one embodiment, method 100 further includes welding the joint 194 between end faces 112 and 114 to form a weld joint 196. For that purpose, system 130 may include a weld head 170 that welds joint 194 while ring 190 is still in place around mandrel 140. Weld head 170 may be a laser weld head or a gas metal arc weld head, e.g., a metal inert gas weld head or tungsten inert gas weld head.

The length 116 of metal sheet 110 substantially matches the circumference of mandrel 140 such that end faces 112 and 114 face each other and meet when metal sheet 110 is bent around mandrel 140. Without departing from the scope hereof, a small gap may exist at joint 194 between end faces 112 and 114, after bending of metal sheet 110 by system 130. In an embodiment where joint 194 is welded, weld material may fill such a gap. Clamping of metal sheet 110 to mandrel 140 ensures that metal sheet 110 does not slip relative to mandrel 140, which in turn ensures a precise joint 194 between end faces 112 and 114. If, in the absence of clamping, metal sheet 110 slipped relative to mandrel 140, the shapes and/or positions of dies 160 may no longer be able to join end faces 112 and 114.

Method 100 is capable of bending a thick metal sheet 110 to form a thick ring 190 with high precision of size and shape of ring 190 as well as high precision of the joint 194 between end faces 112 and 114. Method 100 does not require heating of metal sheet 110 during bending to form ring 190. In one scenario, the temperature of metal sheet 110 during bending is no less than 25 degrees Celsius or no greater than 40 degrees Celsius.

Figure 2:
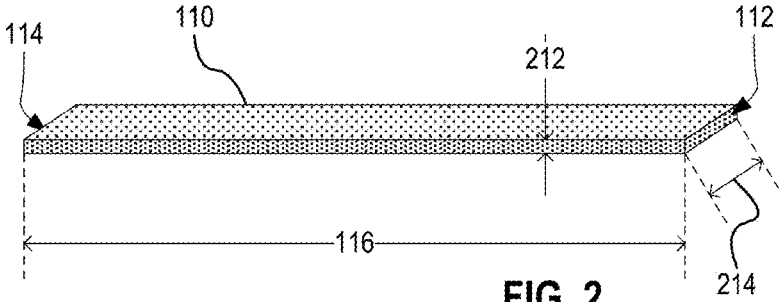
FIG. 2 shows the metal sheet of FIG. 1 in further detail, according to an embodiment.

FIG. 2 shows metal sheet 110 in further detail. Metal sheet 110 has length 116, thickness 212, and width 214. In one example, length 116 is in the range between 5 inches and 100 inches, thickness 212 is in the range between 0.125 inches and 1 inch, and width 214 is in the range between 0.125 inches and 200 inches. In another example, length 116 is in the range between 15 inches and 40 inches, thickness 212 is in the range between 0.1 inches and 0.5 inches, and width 214 is in the range between 0.25 inches and 200 inches. Width 214 may be significantly less than length 116, such that metal sheet 110 is shaped like a strip.

In one embodiment, the ratio of thickness 212 to length 116 is in the range between 0.05 and 1. As will be discussed in further detail below, the force required to bend metal sheet 110 into ring 190 may depend on (a) material properties of metal sheet 110, (b) the ratio of thickness 212 to length 116 or a subsection of length 116, and (c) the minimum radius of curvature imparted on metal sheet 110.

Metal sheet 110 is, for example, made of steel, iron, aluminum, copper, titanium, or another non-ferrous metal or metal alloy.

Figure 3:
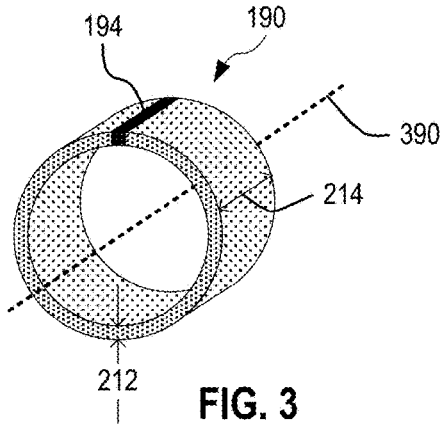
FIG. 3 shows the ring of FIG. 1 in further detail, according to an embodiment.

FIG. 3 shows ring 190 in further detail. Ring 190 encloses an axis 390 parallel to width 214. When ring 190 is mounted on mandrel 140 in FIG. 1, axis 390 is perpendicular to the plane of FIG. 1. Joint 194 extends along all of width 214. In one embodiment, joint 194 is parallel to width 214 and axis 390, which corresponds to end faces 112 and 114 being perpendicular to length 116 of metal sheet. Generally, the profile of ring 190, in dimensions orthogonal to axis 390, is the same along all of width 214. The path prescribed by ring 190 about axis 390 has length substantially similar to length 116, such that end faces 112 and 114 meet or nearly meet at joint 194. While ring 190 may be cylindrical, as depicted in FIG. 3, it is understood that the cross sectional profile of ring 190 (in dimensions perpendicular to axis 390) may be different from circular as discussed above in reference to FIG. 1.

Figure 4:
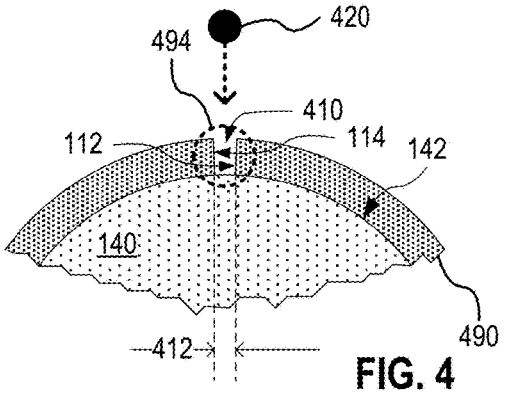
FIG. 4 illustrates welding of a joint between end faces of the metal sheet in a ring that has a gap between the end faces, according to an embodiment.

FIG. 4 illustrates welding of a joint 494 between end faces 112 and 114 in a ring 490 having a gap 410 between end faces 112 and 114. Ring 490 is an embodiment of ring 190 and may have cross sectional shape different from that shown in FIG. 4, as discussed above in reference to FIG. 1. Joint 494 is an embodiment of joint 194. FIG. 4 shows a portion of ring 490 while still in place around mandrel 140. Upon welding of joint 494, weld material 420 bridges across gap 410. Weld material 420 may fill gap 410 entirely. In one example, distance 412 across gap 410, between end faces 112 and 114, is less than 0.02 inches.

Although FIG. 4 shows gap 410 such that end faces 112 and 114 do not contact each other, gap 410 may instead exist only between some portions of end faces 112 and 114, without departing from the scope hereof. For example, end faces 112 and 114 may touch each other closest to surface 142, while not touching each other furthest from surface 142.

Figure 5:
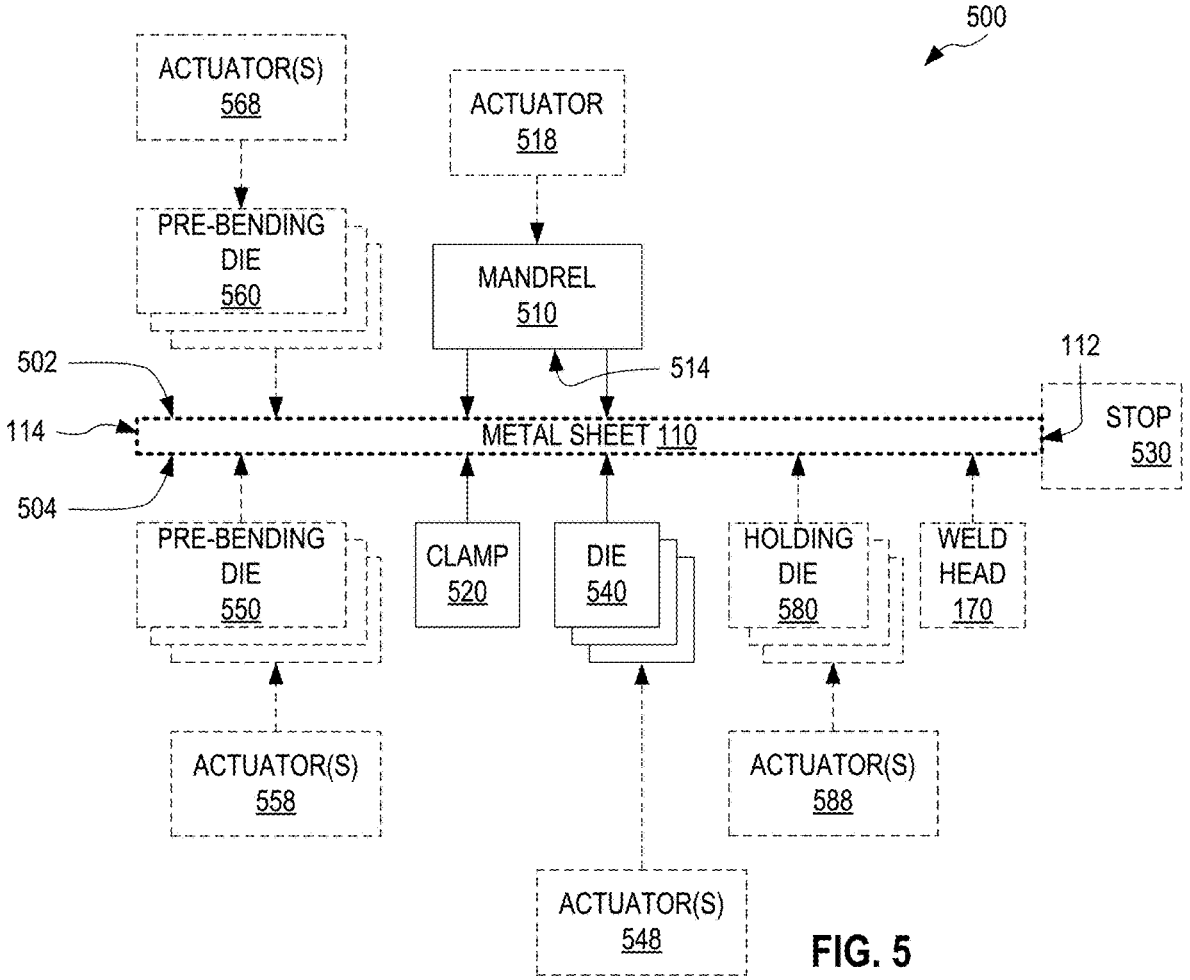
FIG. 5 is a block diagram of a system for manufacturing a ring from a metal sheet, according to an embodiment.

FIG. 5 is a block diagram of one system 500 for manufacturing ring 190 from metal sheet 110. System 130 is an example of system 500. System 500 may manufacture ring 190 from metal sheet 110. System 500 includes a mandrel 510, a clamp 520, and at least one die 540. Mandrel 140, clamp 150, and die(s) 160 are examples of mandrel 510, clamp 520, and dies 540, respectively. Mandrel 510 has a ring-shaped surface 514 that forms a closed loop around mandrel 510.

When system 500 receives metal sheet 110, a side 502 of metal sheet 110 faces mandrel 510, and an opposite side 504 of metal sheet 110 faces clamp 520 and dies 540. Clamp 520 is configured to clamp a part of metal sheet 110 against ring-shaped surface 514 of mandrel 510 to prevent metal sheet 110 from slipping relative to mandrel 510. Each die 540 is positioned on side 504 of metal sheet 110 and configured to press metal sheet 110 against ring-shaped surface 514 to bend at least a segment of metal sheet 110 according to ring-shaped surface 514. In embodiments of system 500 having more than one die 540, different dies 540 may be applied at the same time or successively.

In certain embodiments, system 500 includes a stop 530. In operation of such embodiments, end face 112 of metal sheet 110 is registered against stop 530 to achieve a desired positioning of metal sheet 110 relative to mandrel 510. Stop 530 then maintains this positioning of metal sheet 110 during clamping of metal sheet 110 against mandrel 510 by clamp 520. After that metal sheet 110 has been clamped by clamp 520, stop 530 is no longer needed but may remain in place in system 500.

In one embodiment, system 500 further includes at least one pair of a pre-bending die 550 and a pre-bending die 560. Pre-bending die 550 is positioned on side 504 of metal sheet 110, whereas pre-bending die 560 is positioned on side 502 of metal sheet 110. Each pair of pre-bending dies 550 and 560 function to bend a segment of metal sheet 110, prior to bending of metal sheet 110 with mandrel 510 and die(s) 540, by pressing metal sheet 110 between pre-bending die 550 and pre-bending die 560.

System 500 may further include one or more holding dies 580 that holds metal sheet 110 in place to secure the positions of end faces 112 and 114 during welding of joint 194 therebetween. System 500 may also include weld head 170.

System 500 may include one or more actuators that move the parts needing to move to bend metal sheet 110. In one implementation, each die 540 is fixed and mandrel 510 moves toward die(s) 540 to bend metal sheet 110. In this implementation, system 500 may include actuator 518 that moves mandrel 510 toward die(s) 540. In another implementation, mandrel 510 is fixed and each die 540 moves toward mandrel 510 to bend metal sheet 110. In this implementation, system 500 may include one or more actuators 548 that move one or more dies 540 toward mandrel 510, for example one actuator 548 for each die 540. In yet another implementation, mandrel 510 and die(s) 540 move toward each other to bend metal sheet 110. In this implementation, system 500 may include actuator 518 and one or more actuators 548. Similarly, system 500 may include (a) one or more actuators 558 that move pre-bending die(s) 550, when included in system 500, (b) one or more actuators 568 that move pre-bending die(s) 560, when included in system 500, and/or (c) one or more actuators 588 that move holding die(s) 580, when included in system 500.

Figure 6:
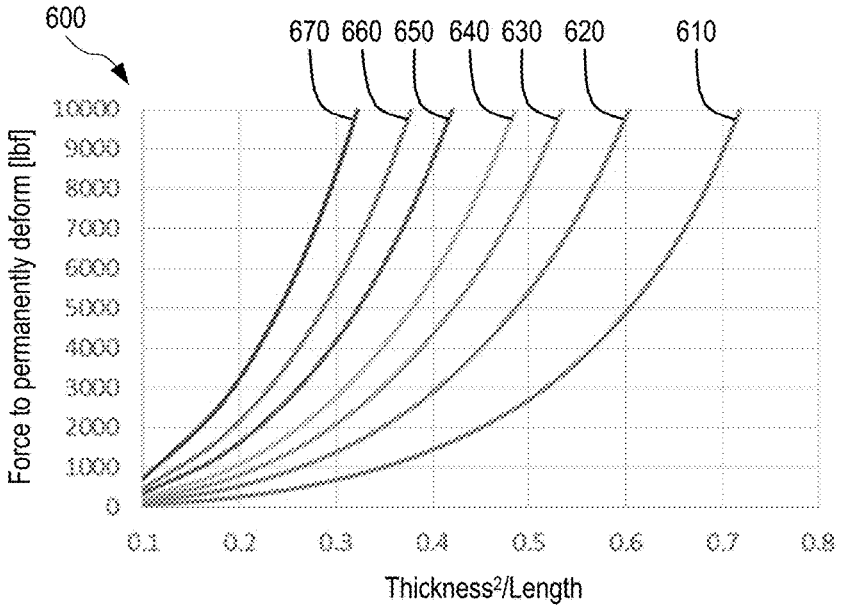
FIG. 6 is a plot of example data that illustrate the relationship between (a) the thickness-to-length ratio of a metal sheet and (b) the force required to permanently deform the metal sheet.

FIG. 6 is a plot 600 that illustrates the relationship between (a) the thickness-to-length ratio of a metal sheet and (b) the force required to permanently deform the metal sheet. The data of plot 600 has been generated for A36 steel, but an at least qualitatively similar behavior is expected for other metals, such as other types of steel. Each curve in plot 600 shows (a) the force, in units of pound-force (lbf), required to bend a metal sheet into a cylindrical ring as a function of (b) the ratio of the thickness of the metal sheet (e.g., thickness 212) to the length of the metal sheet.

Each curve in plot 600 corresponds to a certain width of the metal sheet. The thickness in plot 600 is equivalent to thickness 212, the length in plot 600 is equivalent to length 116, and the width in plat 600 is equivalent to width 214. Plot 600 is based upon the expression $$W = \frac{8I\sigma_y}{Lh}, \quad \text{(Eq. 1)}$$

wherein W is the force, I is the moment of inertia, $\sigma_3$, is the yield strength, L is the length between supports (see, e.g., distance 162 between corners of dies 160 in FIG. 1), and h is the material thickness. For a rectangular cross section, the moment of inertia I is given by $$I = \frac{bh^3}{12}, \quad \text{(Eq. 2)}$$

wherein b is the width of the metal sheet. Using this expression for the moment of inertia, the force may be expressed as $$W = \frac{2}{3}\frac{bh^2\sigma_y}{L}. \quad \text{(Eq. 3)}$$

Curves 610, 620, 630, 640, 650, 660, and 670 correspond to widths b of 0.25 inches, 0.5 inches, 0.75 inches, 1.0 inches, 1.5 inches, 2.0 inches, and 3.0 inches, respectively.

As an example, it is evident from Eq. 3 that a force of 800 lbf is needed to make an 8.5 inch diameter circle from an A36 metal sheet that is 0.375 inches thick and 2 inches wide. 800 lbf is easily achieved with an actuator. Actuators exist that can provide 100,000 lbf or more, but more common (and economic) actuators provide 10,000 lbf or less.

Referring again to system 500 and metal sheet 110, actuators of system 500 may be selected based upon plot 600 and the desired radius of curvature of bends imparted by the actuators.

Steel manufacturers publish suggested minimum bend radii for cold forming of steel. For example, Table 1 below shows suggested minimum inside bend radii for cold forming provided in AISI standard T-298W from the American Iron and Steel Institute.

TABLE 1

| Steel | Thickness (t) [inches] | | | |
|---|---|---|---|---|
| type | Up to ¾ | Over ¾ to 1, incl. | Over 1 to 2, incl. | Over 2 |
| A36 | 1.5t | 1.5t | 1.5t | 2.0t |
| A572-50 | 1.5t | 1.5t | 2.0t | 2.5t |
| A588 | 1.5t | 1.5t | 2.0t | 2.5t |
| A656-70 | 1.5t | 1.5t | — | — |
| A514 | 1.75t | 2.25t | 4.5t | 5.5t |

For example, for A36 steel with a thickness of 0.375 inches, AISI standard T-298W suggests a minimum inside bend radii of 1.5t, that is, 0.5685 inches.

Referring again to system 500, metal sheet 110, and ring 190, possible shapes of ring 190 formed by system 500 from metal sheet 110 may be obtained by considering the minimum inside bend radii suggested by AISI standard T-298W or other similar industry standards. For example, if the goal is to form a rectangular ring 190 having a certain thickness, such industry standards may provide information about the minimum radii of curvature of corners of the rectangular profile. In one embodiment, the thickness of metal sheet 110 is in the range between 0.125 inches and 1.0 inches, metal sheet 110 is made of steel, and the minimum radius of curvature of ring 190 formed therefrom is no greater than 15 inches.

Figure 7:
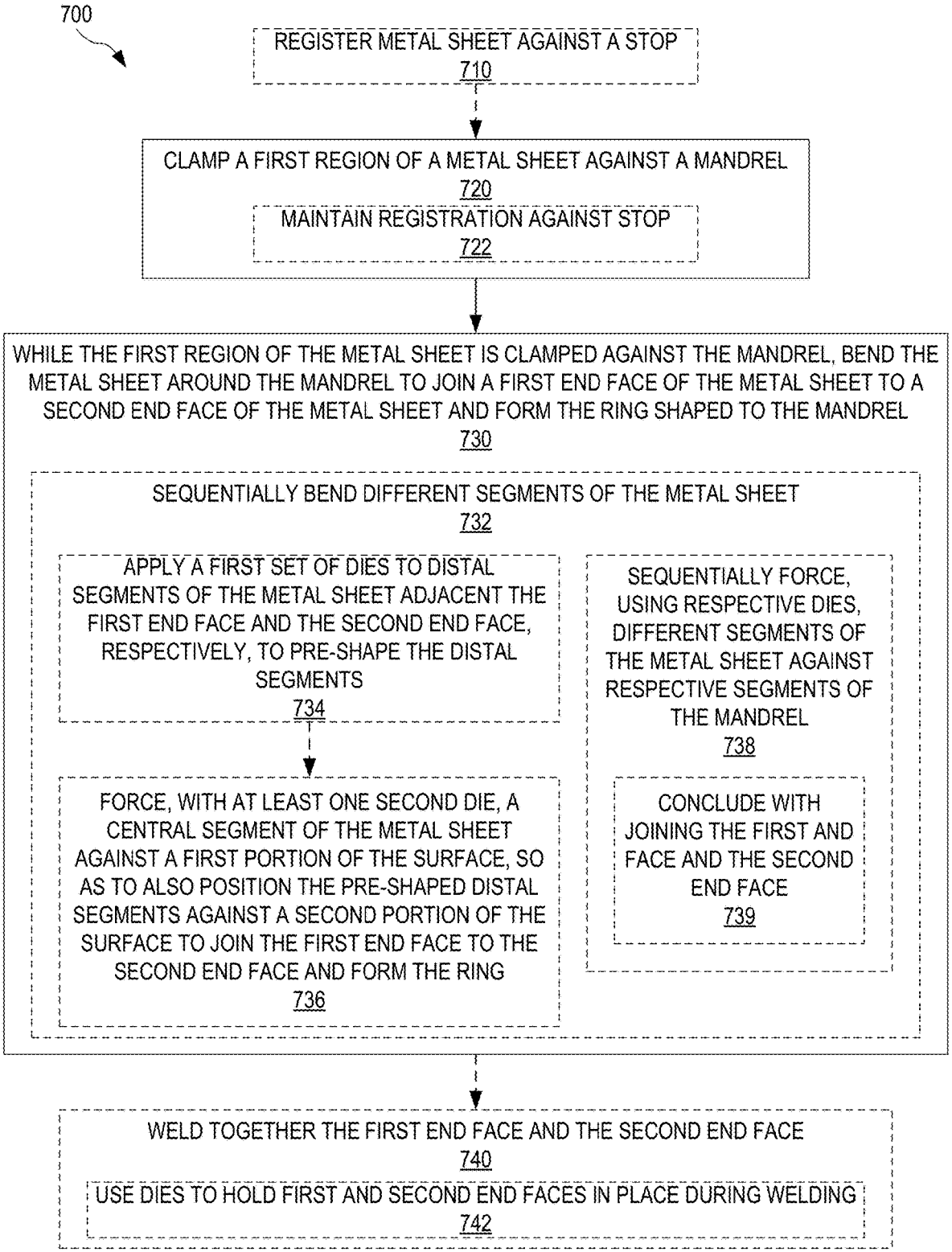
FIG. 7 is a flowchart of a method for manufacturing a ring from a metal sheet, according to an embodiment.

FIG. 7 is a flowchart of one method 700 for manufacturing a ring from a metal sheet. Method 700 may manufacture ring 190 from metal sheet 110, for example using system 500. Method 100 is an example of method 700.

In a step 720, method 700 clamps a first region of a metal sheet against a mandrel. In one example of step 720, clamp 520 clamps a region of metal sheet 110 against mandrel 510, for example in a manner similar to that depicted for clamp 150 and mandrel 140 in FIG. 1. Step 720 ensures that the metal sheet does not slip relative to the mandrel during subsequent bending of the metal sheet in method 700.

In one embodiment, method 700 includes a step 710 of registering the metal sheet against a stop prior to clamping the metal sheet in step 720. In this embodiment, step 720 further includes a step 722 of maintaining the registration while clamping the metal sheet against the mandrel, such that a desired portion of the metal sheet is clamped against the mandrel. In one example of steps 710, 720, and 722, metal sheet 110 is registered against stop 530 in step 710, and this registration is maintained while clamp 520 clamps metal sheet 110 against mandrel 510 in step 720. In certain scenarios, the registration achieved in step 710 is needed to ensure that subsequent bending of the metal sheet results in forming a ring of the intended shape and size. Without departing from the scope hereof, step 710 may achieve registration of the metal sheet relative to the mandrel without using a stop. In one such example, step 710 receives metal sheet 110 from a feeder system that feeds metal sheet 110 a certain distance into the system 500. Step 710 may further utilize machine vision, together with a feeder system, to position a marked location of metal sheet 110 at a desired location in system 500. Alternatively, step 710 may cut metal sheet 110 to length after that metal sheet 110 has been clamped to the mandrel in step 720.

In a step 730, method 700 bends the metal sheet around the mandrel to join a first end face of the metal sheet to a second end face of the metal sheet and form the ring shaped to the mandrel. Method 700 performs step 730 while the first region of the metal sheet is still clamped against the mandrel. In one example of step 730, mandrel 510 and one or more dies 540 are moved toward each other to shape metal sheet 110 against ring-shaped surface 514 of mandrel 510, while clamp 520 continues to clamp metal sheet 110 against mandrel 510. This example of step 730 may also utilize one or more pairs of pre-bending dies 550 and 560 to pre-bend one or more segments of metal sheet 110 prior to shaping metal sheet 110 against ring-shaped surface 514 of mandrel 510.

In certain embodiments, step 730 includes a step 732 of sequentially bending different segments of the metal sheet. In one example of step 732, different dies 540 are applied sequentially to shape different segments of metal sheet 110 against ring-shaped surface 514 of mandrel 510. In another example of step 732, one or more pairs of pre-bending dies 550 and 560 pre-bend respective distal segments of metal sheet 110 prior to dies 540 cooperating with mandrel 510 to bend one or more central segments of metal sheet 110, so as to shape metal sheet 110 according to ring-shaped surface 514.

In one embodiment, step 732 includes steps 734 and 736. Step 734 applies a first set of dies to distal segments of the metal sheet adjacent the first end face and the second end face, respectively, to pre-shape the distal segments. Step 736 forces, with at least one second die, a central segment of the metal sheet against a first portion of the ring-shaped surface of the mandrel, so as to also position the pre-shaped distal segments against a second portion of the ring-shaped surface of the mandrel to join the first end face to the second end face. The shape imparted on the distal segments in step 734 is such that when the central segment of the metal sheet is shaped against the one portion of the ring-shaped surface of the mandrel, the distal segments come into place against other portions of the ring-shaped surface of the mandrel. Step 736 thereby completes forming of the ring. In one example of step 734, one pair of pre-bending dies 550 and 560 is applied to a distal segment of metal sheet 110 adjacent end face 112 and another pair of pre-bending dies 550 and 560 is applied to a distal segment of metal sheet 110 adjacent end face 114, to pre-bend these two distal segments. Next, in this example, in step 736, mandrel 510 cooperates with one or more dies 540 to shape the central segment of metal sheet 110, between the distal segments pre-bent in step 734, against a portion of the ring-shaped surface of the mandrel. The bending of the central segment of metal sheet 110 imparted by die(s) 540 and mandrel 510 in step 736 also positions the pre-bent distal segments of metal sheet 110 against ring-shaped surface 514 of mandrel 510.

In another embodiment, step 732 includes a step 738 of using different dies to sequentially force different respective segments of the metal sheet against respective segments of the mandrel. In one example of step 738, different dies 540 sequentially press different segments of metal sheet 110 against ring-shaped surface 514 of mandrel 510. Step 738 may conclude with a step 739 of joining the first end face to the second end face. In one example of step 739, the last bending operation by dies 540 and mandrel 510 results in joining end face 112 to end face 114. Without departing from the scope hereof, step 736 may implement step 738 with or without step 739.

Optionally, method 700 further includes a step 740 of welding together the first and second end faces. In one example of step 740, weld head 170 welds joint 194 to form weld joint 196. Step 740 may include a step 742 of using dies to hold first and second end faces in place during welding. In one example of step 742, two holding dies 580 hold end faces 112 and 114 in place during welding of joint 194 by weld head 570. In this example, holding dies 580 may press distal segments of metal sheet 110 (now facing each other on mandrel 510) toward each other to ensure that end faces 112 and 114 remain aligned and in closest possible proximity to each other during welding by weld head 570.

Although not shown in FIG. 7, method 700 may include a step of cutting the metal sheet from a metal stock such that the distance between the two end faces of the metal sheet matches the length of the perimeter of the mandrel surface used to shape the metal sheet in step 730, or such that the distance between the end faces is shorter than the length of the perimeter of the mandrel surface by at most 0.02 inches. In scenarios where there is a gap between the end faces after being of the metal sheet around the mandrel in step 730, welding in step 740 may bridge this gap (see gap 410 in FIG. 4), at least for gaps no greater than 0.02 inches.

Figure 8:
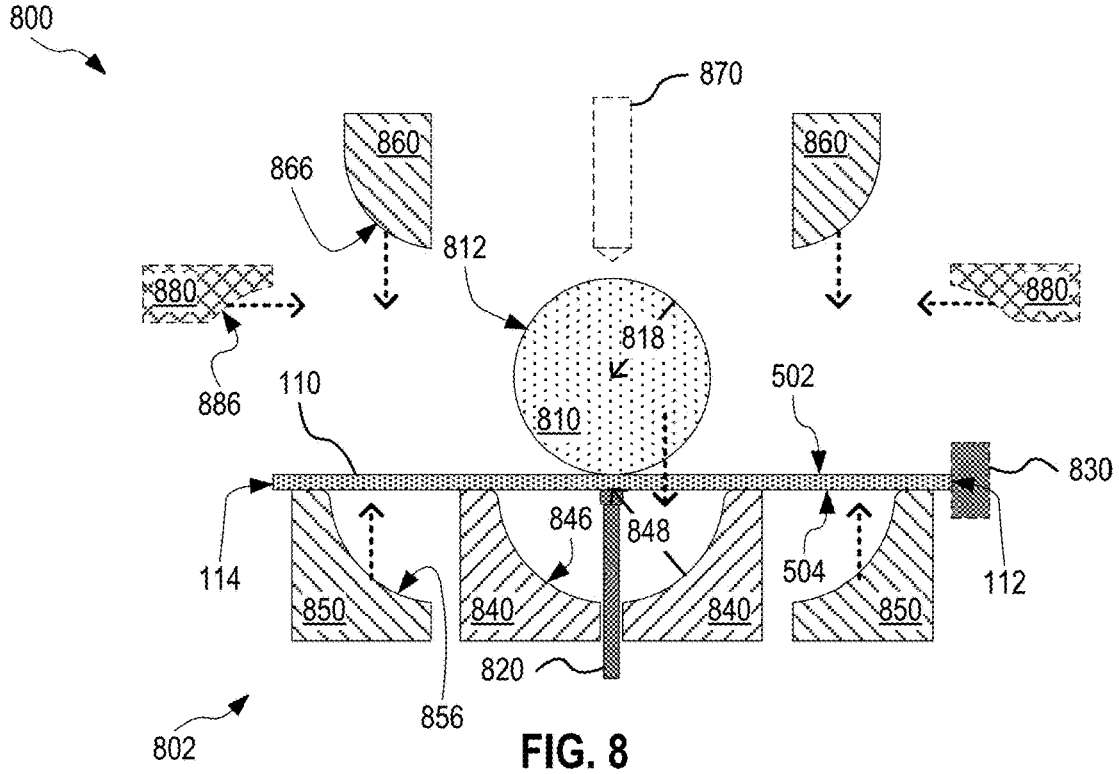
FIG. 8 illustrates a system for manufacturing a cylindrical ring from a metal sheet, according to an embodiment.

FIG. 8 illustrates, in cross-sectional side view, one system 800 for manufacturing a cylindrical ring from metal sheet 110. System 800 is an embodiment of system 500. System 800 is configured to form a cylindrical embodiment of ring 190 from metal sheet 110. System 800 includes a mandrel 810, a clamp 820, two dies 840, and two pairs of pre-bending dies 850 and 860. Mandrel 810, clamp 820, dies 840, and pre-bending dies 850 and 860 are embodiments of mandrel 510, clamp 520, dies 540, and pre-bending dies 550 and 560, respectively.

Mandrel 810 has a cylindrical surface 812 that forms a closed loop around mandrel 810. Each of dies 840 has a cylindrical surface 846, truncated to only 90 degrees or less of a full 360 degrees cylindrical surface. When mandrel 810 is brought together with dies 840, cylindrical surface 812 and cylindrical surfaces 846 cooperate to bend a central segment of metal sheet 110 into a semi-cylindrical wall. Cylindrical surface 812 has radius of curvature 818 (which has the same length as the radius of cylindrical surface 812 due to the cylindrical geometry). Due to the thickness 212 of metal sheet 110, the radius of curvature 848 of each truncated cylindrical surface 846 is somewhat larger than radius of curvature 818 such that, when bending metal sheet 110 into a cylindrical shape between mandrel 810 and dies 840, cylindrical surface 812 matches an inner surface of the cylindrically shaped metal sheet (on side 502 of metal sheet 110) whereas truncated cylindrical surfaces 846 match an outer surface of the cylindrically shaped metal sheet (on side 504 of metal sheet 110). Without departing from the scope hereof, dies 840 may be a single, integrally formed piece with a pass-through for clamp 820, or dies 840 may be rigidly connected to each other. In the embodiment depicted in FIG. 8, dies 840 are configured to be stationary and mandrel 810 is configured to be moveable toward dies 840. However, in an alternative embodiment, mandrel 810 is stationary and dies 840 are moveable, or both mandrel 810 and dies 840 are moveable.

Each pair of pre-bending dies 850 and 860 is positioned to bend a respective distal segment of metal sheet 110 into a section of a cylindrical wall, approximately a quarter-cylindrical wall. Each pre-bending die 850 has a truncated cylindrical surface 856 characterized by substantially the same radius of curvature as truncated cylindrical surface 846, since pre-bending die 850 acts on side 504 of metal sheet 110. Each pre-bending die 860 has a truncated cylindrical surface 866 characterized by substantially the same radius of curvature as cylindrical surface 812, since pre-bending die 860 acts on side 502 of metal sheet 110.

In one embodiment, system 800 further includes a stop 830. Stop 830 is an embodiment of stop 530. System 800 may further include two holding dies 880. Holding dies 880 are embodiments of holding dies 580. Each holding die 880 has a truncated cylindrical surface 886 characterized by substantially the same radius of curvature as cylindrical surface 846, since holding die acts on side 504 of metal sheet 110. Optionally, system 800 includes a weld head 870. Weld head 870 is an embodiment of weld head 570. Although for clarity not depicted in FIG. 8, system 800 may further include an actuator for each of mandrel 810, dies 840, pre-bending dies 850 and 860, and holding dies 880.

FIGS. 8-12 together illustrate one method 802 for manufacturing a cylindrical ring from metal sheet 110, using system 800. Each of FIGS. 8-12 shows, in cross-sectional side view, a different stage of method 802. Method 802 is an embodiment of method 700 that includes steps 734 and 736. FIGS. 8-12 are best viewed together in the following description.

Referring first to FIG. 8, clamp 820 clamps the center of metal sheet 110 against cylindrical surface 812 of mandrel 810, in an embodiment of step 720. Prior to this step, metal sheet 110 may have been registered against stop 830, in an embodiment of step 710.

Figure 9:
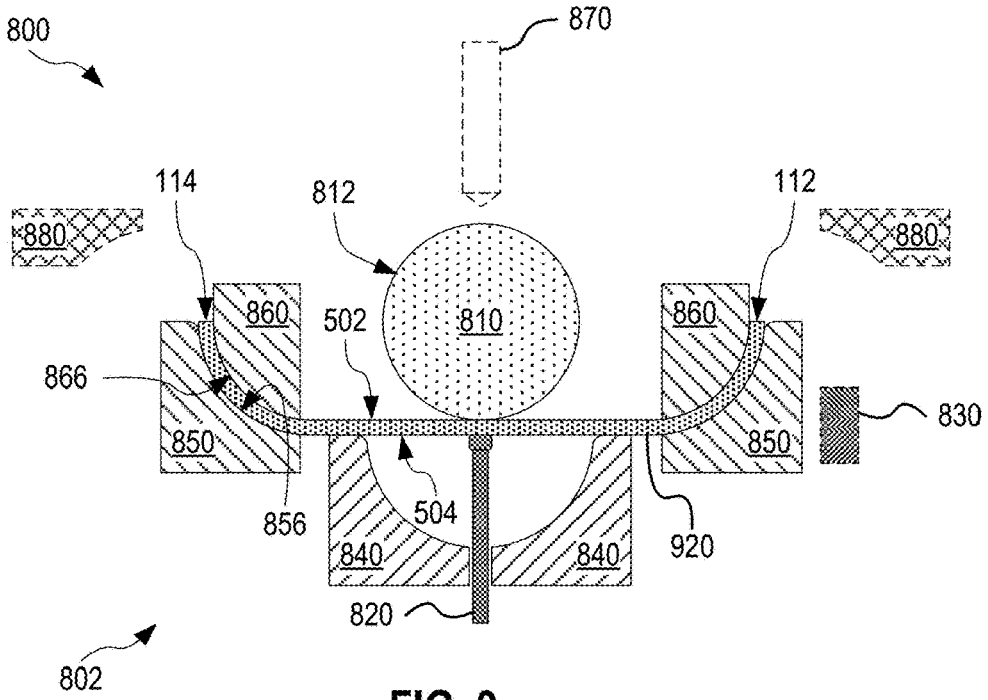

Next, as shown in FIG. 9, for each distal end of metal sheet 110 adjacent end faces 112 and 114, a respective pair of pre-bending dies 850 and 860 move toward each other from opposite sides of metal sheet 110 to bend the distal end into a quarter-cylindrical wall between surfaces 856 and 866, in an embodiment of step 734. At this stage, metal sheet 110 has been bent into a workpiece 920.

Figure 10:
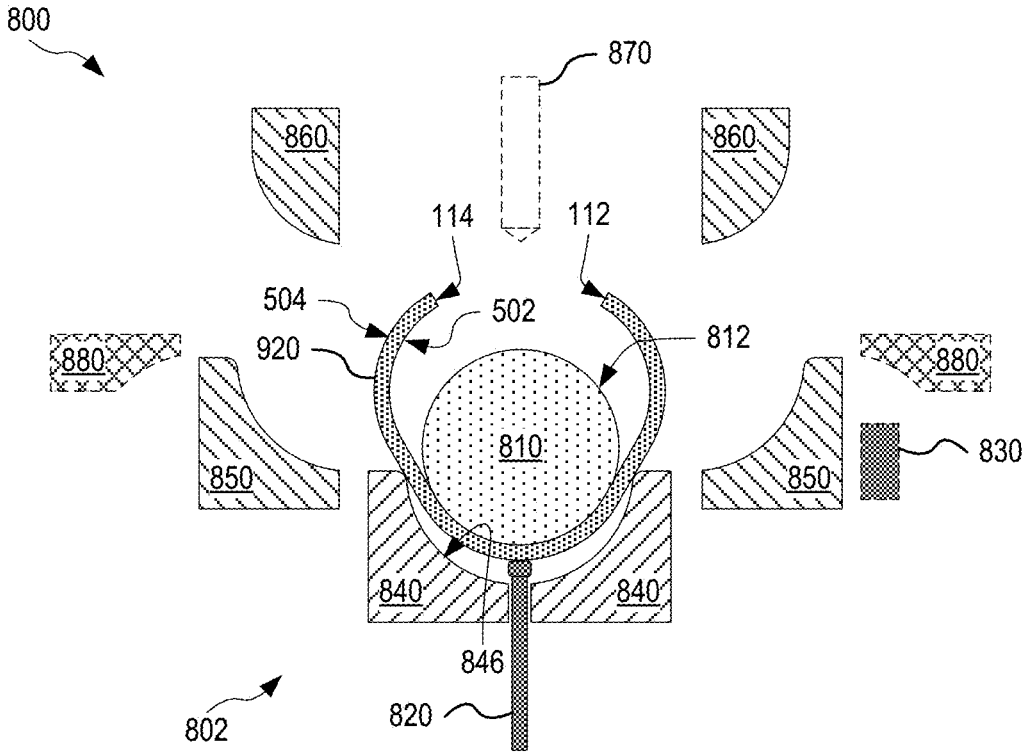
Figure 11:
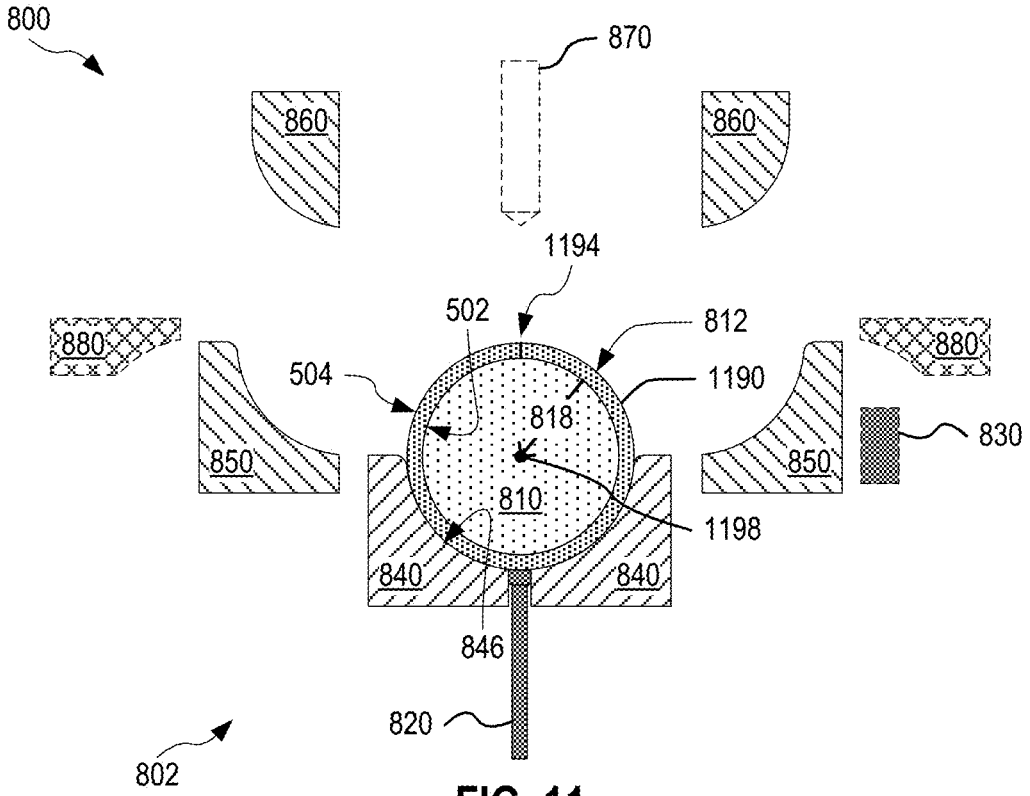

FIGS. 10 and 11 show further bending of workpiece 920, in an embodiment of step 736. At this stage, pre-bending dies 860 have been moved away from workpiece 920, and mandrel 810 is moved toward dies 840 to force workpiece 920 toward surfaces 846 (see FIG. 10). This causes the pre-bent distal segments to swing toward mandrel 810, as shown in FIG. 10, until mandrel 810 bottoms out in dies 840 with workpiece 920 pressed tight between cylindrical surface 812 and truncated cylindrical surfaces 846 and end faces 112 and 114 join each other at joint 1194, as shown in FIG. 11. At the stage shown in FIG. 11, workpiece 920 has been bent to form a cylindrical ring 1190. The inner radius of cylindrical ring 1190 is the same as the radius of cylindrical surface 812, that is, the length of radius of curvature 818. Relative to cylinder axis 1198 (see FIG. 11) of ring 1190, joint 1194 is at an azimuthal position that is opposite clamp 820.

Method 802 provides one example of the benefit of clamping metal sheet 110 to the mandrel. If metal sheet 110, in the absence of clamping, was allowed to slip relative to cylindrical surface 812, in dimensions in the plane of the cross-sectional views provided in FIGS. 8-11, end faces 112 and 114 would not meet. Method 802 also provides an example of the benefit of registering metal sheet 110 against a stop. Method 802 relies on the center of metal sheet 110 being clamped to cylindrical surface 812. Stop 830 is a relatively simple way of ensuring that the center of metal sheet 110 is positioned over clamp 820. If, prior to clamping by clamp 820, metal sheet 110 was inadvertently offset to, e.g., the left in FIG. 8, (a) the distal segment adjacent end face 114 would be pre-bent in FIG. 9 to have a quarter-cylindrical segment distanced from end face 114 by a remaining straight section, and (b) the distal segment adjacent end face 112 would form less than a quarter of a cylindrical wall. The subsequent bending by mandrel 810 and dies 840 in FIGS. 10 and 11, would not result in end faces 112 and 114 joining, and metal sheet 110 would not form a ring. Method 802 and system 800 may utilize other functionality than stop 830 for properly positioning the center of metal sheet over clamp 820. In one example, system 800 is coupled with a feeder system that feeds metal sheet 110 a certain distance into system 800, and system 800 may further include a machine vision module that works with the feeder system to position a marked center of metal sheet 110 over clamp 820. Alternatively, metal sheet 110 may be cut to length after having been clamped to mandrel 810 by clamp 820.

Figure 12:
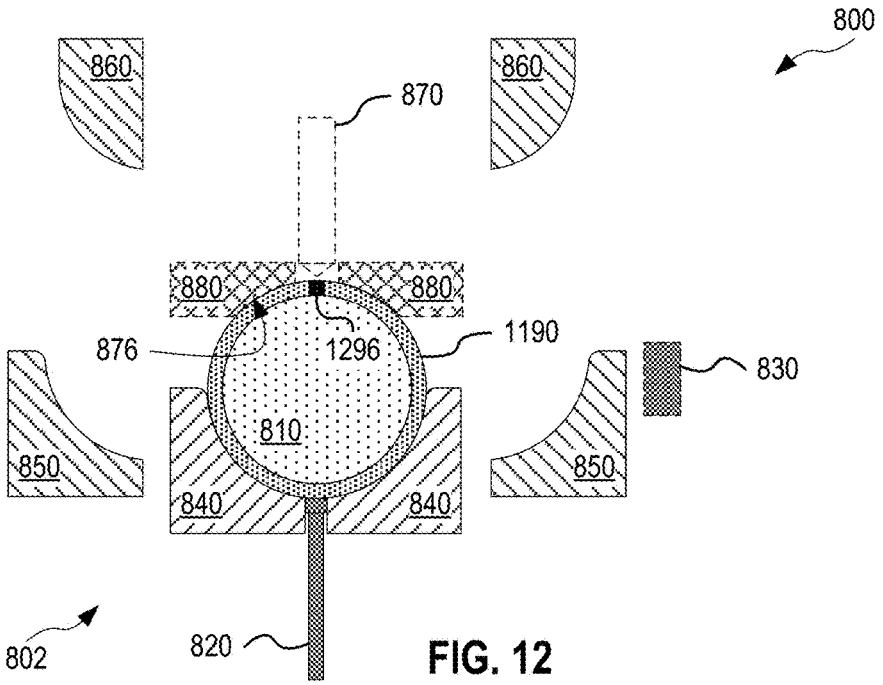

Method 802 may further include welding joint 1194 between end faces 112 and 114. FIG. 12 shows such welding, in an embodiment of step 740. Weld head 870 is moved into place at joint 1194 to form a weld joint 1296. In scenarios where width 214 of metal sheet 110 exceeds the area that may be welded by a stationary weld head, weld head 870 may be translated along the cylinder axis of cylindrical ring 1190 (orthogonal to the cross section shown in FIG. 12) to weld the entire length of joint 1194. Optionally, as shown in FIG. 12, in an embodiment of step 742, holding dies 880 press against ring 1190 to hold end faces 112 and 114 in place at joint 1194 during welding thereof. Positioning of holding dies 880 at ring 1190, as shown in FIG. 12, may require moving pre-bending dies 850 downwards from their position in FIG. 10.

Figure 13:
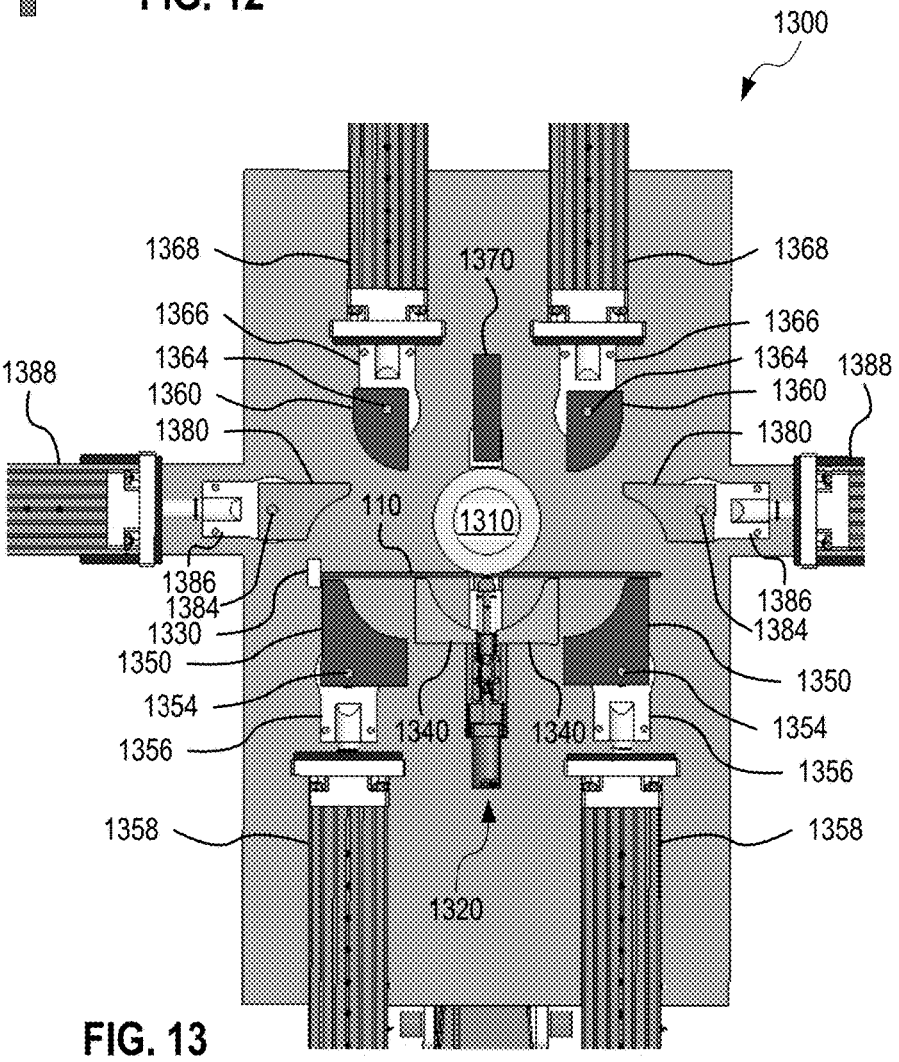
FIG. 13 illustrates, in cross-sectional side view, another system for manufacturing a cylindrical ring from a metal sheet, according to an embodiment.

FIG. 13 illustrates, in cross-sectional side view, another system 1300 for manufacturing a cylindrical ring from metal sheet 110. System 1300 is an embodiment of system 800. System 1300 is configured to perform an embodiment of method 700 that includes steps 710, 722, 734, 736, 740, and 742.

System 1300 includes a mandrel 1310, a clamp 1320, a stop 1330, two dies 1340, two pairs of pre-bending dies 1350 and 1360, two holding dies 1380, and a weld head 1370. Mandrel 1310, clamp 1320, stop 1330, dies 1340, pre-bending dies 1350 and 1360, holding dies 1380, and weld head 1370 are embodiments of mandrel 810, clamp 820, stop 830, dies 840, pre-bending dies 850 and 860, holding dies 880, and weld head 870, respectively.

For each pre-bending die 1350, system 1300 further includes an actuator 1358 coupled to pre-bending die 1350 via a die mount 1356. Actuator 1358 translates die mount 1356 vertically in FIG. 13. In an embodiment, the joint 1354 between each pre-bending die 1350 and the respective die mount 1356 allows pre-bending die 1350 to pivot relative to die mount 1356, at least to a certain degree. Similarly, for each pre-bending die 1360, system 1300 further includes an actuator 1368 coupled to pre-bending die 1360 via a die mount 1366. Actuator 1368 translates die mount 1366 vertically in FIG. 13. In an embodiment, the joint 1364 between each pre-bending die 1360 and the respective die mount 1366 allows pre-bending die 1360 to pivot relative to die mount 1366, at least to a certain degree. For each holding die 1380, system 1300 further includes an actuator 1388 coupled to holding die 1380 via a die mount 1386. Actuator 1388 translates die mount 1386 horizontally in FIG. 13. In an embodiment, the joint 1384 between each holding die 1380 and the respective die mount 1386 allows holding die 1380 to pivot relative to die mount 1386, at least to a certain degree. Pivoting of a die relative to its actuator may reduce tolerance requirements to the actuator since the pivoting may allow the die to self-correct if the actuator placement is not exact. Actuators 1358, 1368, and 1388 are embodiments of actuators 558, 568, and 588, respectively. Although not shown in FIG. 13, mandrel 1310 is mounted on an actuator (an embodiment of actuator 518) that translates mandrel 1310 vertically in FIG. 13

Figure 14:
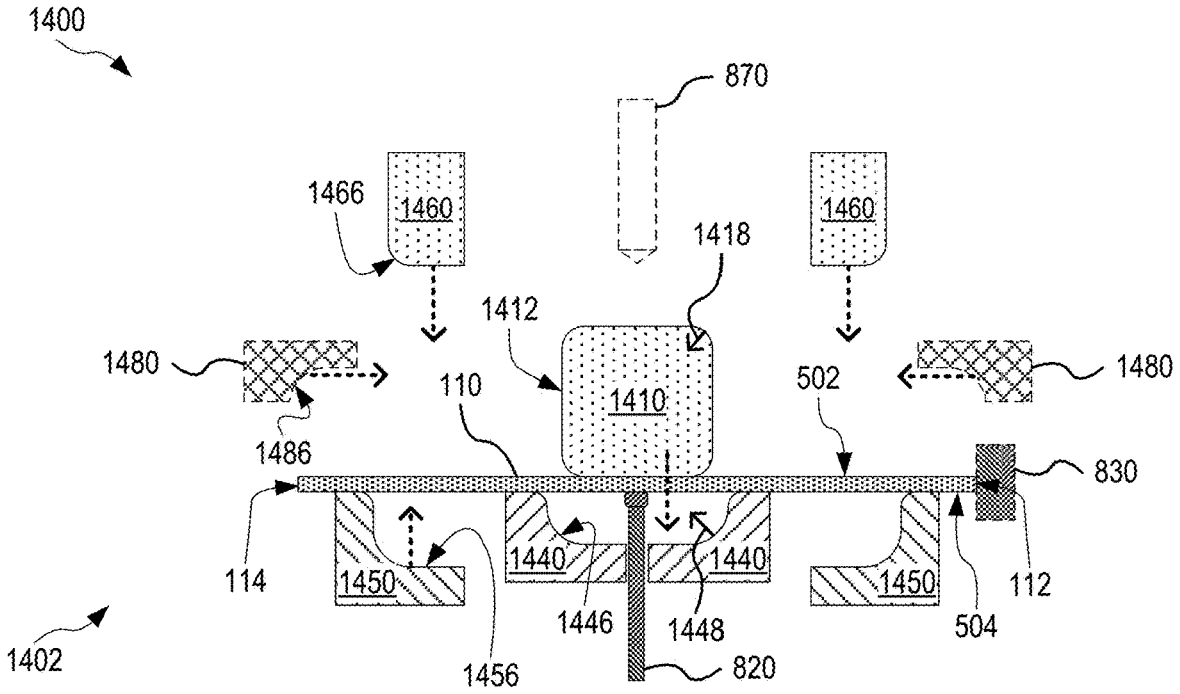
FIG. 14 illustrates a system for manufacturing a ring having a rectangular profile, according to an embodiment.

FIG. 14 illustrates, in cross-sectional side view, one system 1400 for manufacturing a ring, having a rectangular profile, from metal sheet 110. System 1400 is an embodiment of system 500. System 1400 is configured to form an embodiment of ring 190 that has a rectangular profile. System 1400 is conceptually similar to system 800, but utilizes a differently shaped mandrel and differently shaped dies. System 1400 includes a mandrel 1410, clamp 820, two dies 1440, and two pairs of pre-bending dies 1450 and 1460. Mandrel 1410, dies 1440, and pre-bending dies 1450 and 1460 are embodiments of mandrel 510, dies 540, and pre-bending dies 550 and 560, respectively.

Mandrel 1410 has a surface 1412 that forms a closed loop around mandrel 1410. Surface 1410 has a rectangular profile with rounded corners. Each of dies 1440 has a surface 1446 that matches the shape of surface 1412, near a respective lower corner of mandrel 1410, apart from being expanded to accommodate the thickness 212 of metal sheet 110 between surface 1412 and surface 1446. When mandrel 1410 is brought together with dies 1440, surface 1412 and surfaces 1446 cooperate to bend a central segment of metal sheet 110 into a rectangular U-shape with rounded corners. Surface 1412 has a minimum radius of curvature 1418 at each of its corners. Due to the thickness 212 of metal sheet 110, the radius of curvature 1448 of the inside corner of each surface 1446 is somewhat larger than radius of curvature 1418 such that, when bending metal sheet 110 into the rectangular U-shape between mandrel 1410 and dies 1440, surface 1412 matches an inner surface of the rectangular U-shaped metal sheet (on side 502 of metal sheet 110) whereas surfaces 1446 match an outer surface of the rectangular U-shaped metal sheet (on side 504 of metal sheet 110). Without departing from the scope hereof, dies 1440 may be a single, integrally formed piece with a pass-through for clamp 820, or dies 1440 may be rigidly connected to each other. In the embodiment depicted in FIG. 14, dies 1440 are configured to be stationary and mandrel 1410 is configured to be moveable toward dies 1440. However, in an alternative embodiment, mandrel 1410 is stationary and dies 1440 moveable, or both mandrel 1410 and dies 1440 are moveable.

Each pair of pre-bending dies 1450 and 1460 is positioned to impart an L-shaped bend to a respective distal segment of metal sheet 110. Each pre-bending die 1450 has a surface 1456 that matches the shape of surface 1412, near a respective upper corner of mandrel 1410, apart from being expanded to account for the thickness 212 of metal sheet 110. The inside corner of surface 1456 is characterized by substantially the same radius of curvature as surface 1446, since pre-bending die 1450 acts on side 504 of metal sheet 110. Each pre-bending die 1460 has a surface 1466 that is similar to a portion of surface 1412, near a respective upper corner of mandrel 1410. The corner of surface 1466 is characterized by substantially the same radius of curvature as surface 1412, since pre-bending die 1460 acts on side 502 of metal sheet 110.

In one embodiment, system 1400 further includes stop 830. System 1400 may further include two holding dies 1480. Holding dies 1480 are embodiments of holding dies 580. Each holding die 1480 has a surface 1486 that matches the shape of surface 1412, near a respective upper corner of mandrel 1410, apart from being expanded to accommodate the thickness 212 of metal sheet 110 between surface 1486 and surface 1412. The inside corner of surface 1486 is characterized by substantially the same radius of curvature as surface 1446, since holding die acts on side 504 of metal sheet 110. Optionally, system 1400 includes weld head 870. Although for clarity not depicted in FIG. 14, system 1400 may further include an actuator for each of mandrel 1410, dies 1440, pre-bending dies 1450 and 1460, and holding dies 1480.

Figure 15:
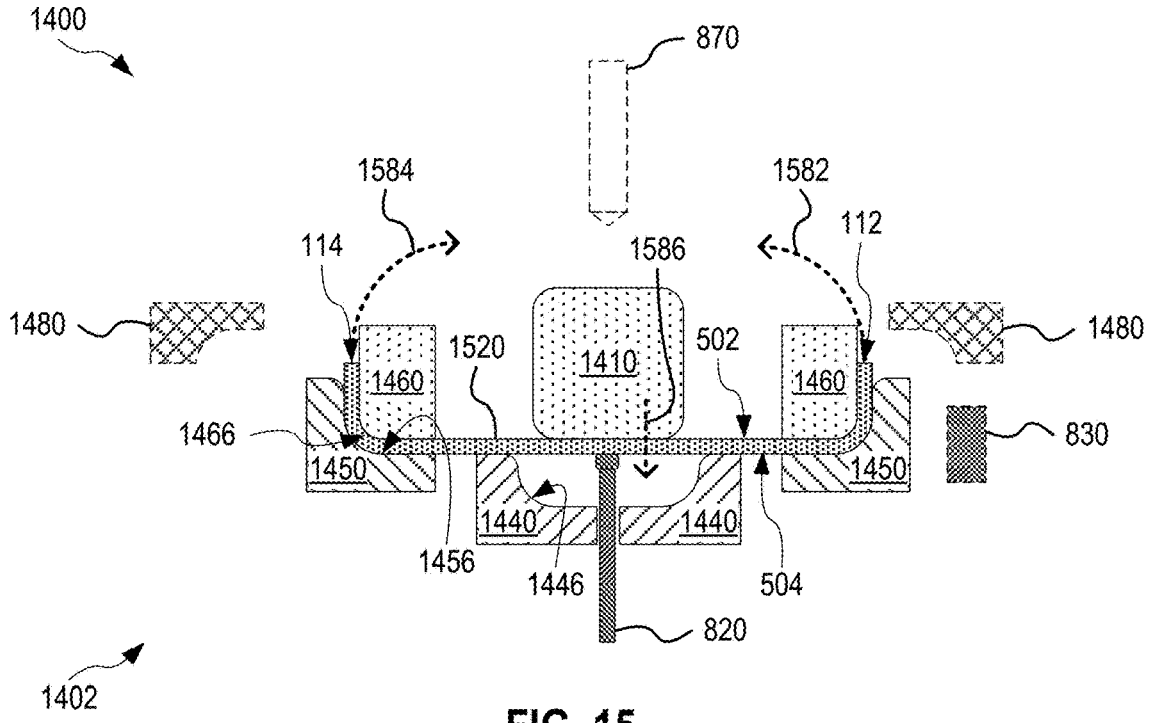
Figure 16:
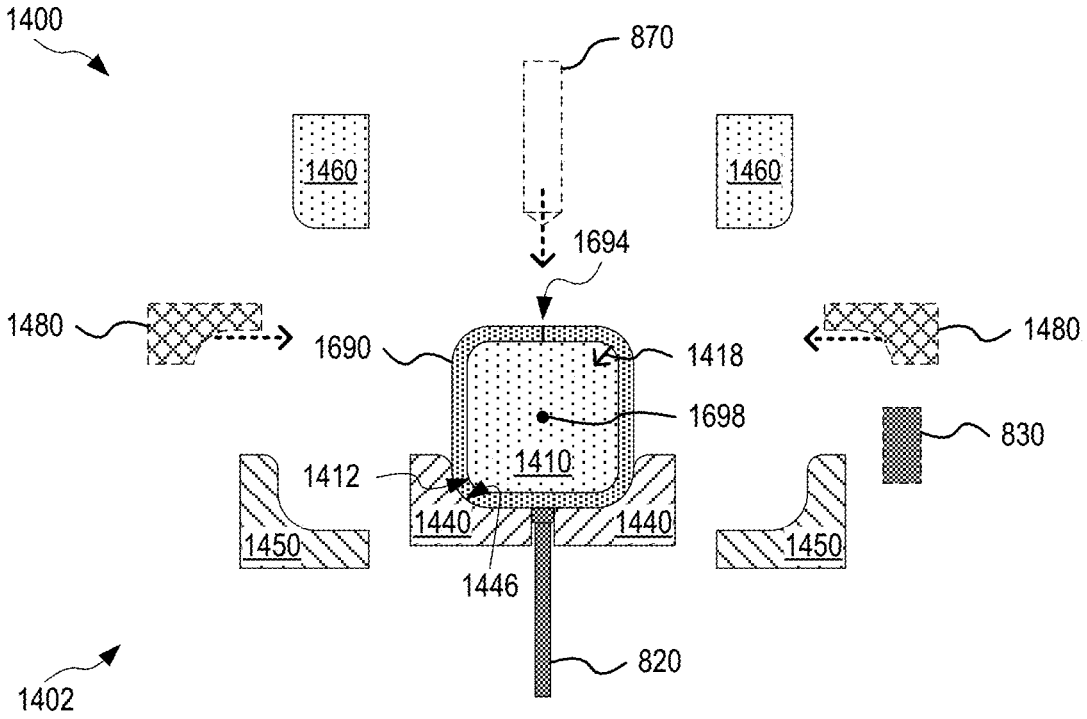

FIGS. 14-16 together illustrate one method 1402 for manufacturing, from metal sheet 110, a ring having a rectangular profile with rounded corners. Method 1402 utilizes system 1400. Each of FIGS. 14-16 shows, in cross-sectional side view, a different stage of method 1402. Method 1402 is an embodiment of method 700 that includes steps 734 and 736. Method 1402 is conceptually similar to method 802 apart from differences in shape of dies, mandrel, and the ring formed by the method. FIGS. 14-16 are best viewed together in the following description.

Referring first to FIG. 14, clamp 820 clamps the center of metal sheet 110 against surface 1412 of mandrel 1410, in an embodiment of step 720. Prior to this step, metal sheet 110 may have been registered against stop 830, in an embodiment of step 710.

Next, as shown in FIG. 15, for each distal end of metal sheet 110 adjacent end faces 112 and 114, a respective pair of pre-bending dies 1450 and 1460 move toward each other from opposite sides of metal sheet 110 to impart a rounded ninety-degree bend to the distal end between surfaces 1456 and 1466, in an embodiment of step 734. At this stage, metal sheet 110 has been bent into a workpiece 1520.

FIGS. 15 and 16 together show further bending of workpiece 1520, in an embodiment of step 736. At this stage, pre-bending dies 1460 have been moved away from workpiece 1520, and mandrel 1410 is moved toward dies 1440 (see arrow 1586 in FIG. 15) to force workpiece 1520 toward surfaces 1446. This causes the pre-bent distal segments to swing toward mandrel 1410 (as indicated by arrows 1584 and 1582 in FIG. 15), until mandrel 1410 bottoms out in dies 1440 with workpiece 1520 pressed tight between surface 1412 and surfaces 1446 (as shown in FIG. 16) and end faces 112 and 114 join each other at joint 1694 (as also shown in FIG. 16). At the stage shown in FIG. 16, workpiece 1520 has been bent to form a ring 1690 having a rectangular profile with rounded corners. The radius of curvature of corners of ring 1690 is the same as the radius of curvature 1418 of 1412. Relative to a longitudinal axis 1698 of ring 1690, joint 1694 is at an azimuthal position that is opposite clamp 820.

Method 1402 provides another example of the benefit of clamping metal sheet 110 to the mandrel, as discussed above in reference to method 802. Method 1402 also provides another example of benefits of registering metal sheet 110 against a stop. Even though the extreme distal ends of metal sheet 110 remain straight in method 1402, which loosens the tolerance requirements to the initial positioning of metal sheet 110 in system 1400, accuracy in the location of joint 1694 is still advantageous in embodiments where ring 1690 is welded while in place on mandrel 1410. If the location of joint 1694 is not accurately controlled, weld head 870 must be actively manipulated to align with joint 1694. Registration of metal sheet 110 against stop 830 (together with clamping) ensures accurate positioning of joint 1694. As discussed above in reference to method 802 and system 800, method 1402 and system 1400 may utilize other functionality than stop 830 for properly positioning the center of metal sheet over clamp 820.

Method 1402 may further include welding joint 1694 between end faces 112 and 114, in a manner similar to that shown for method 802 in FIG. 12. Method 1402 may utilize holding dies 1480 during welding.

Figure 17:
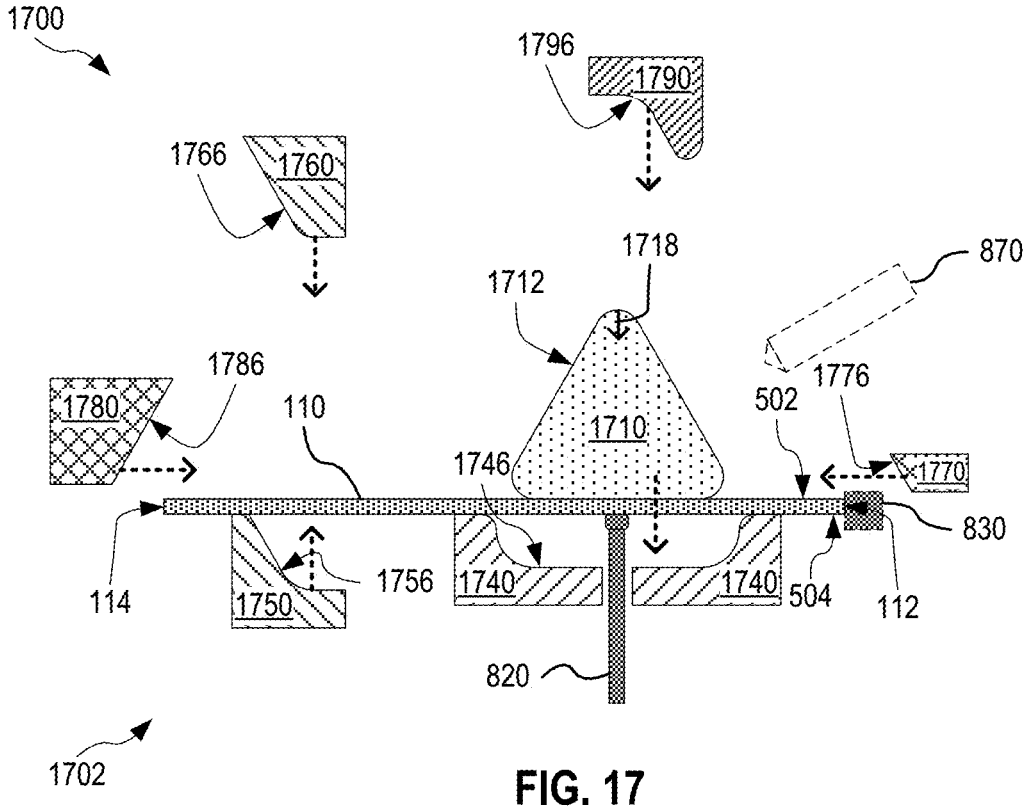
FIG. 17 illustrates a system for manufacturing a ring having a triangular profile, according to an embodiment.

FIG. 17 illustrates, in cross-sectional side view, one system 1700 for manufacturing a ring, having a triangular profile, from metal sheet 110. System 1700 is an embodiment of system 500. System 1700 is configured to form an embodiment of ring 190 that has a triangular profile. System 1700 includes a mandrel 1710, clamp 820, two dies 1740, one pair of pre-bending dies 1750 and 1760, and additional dies 1770, 1780, and 1790. Mandrel 1710 is an embodiment of mandrel 510. Dies 1740, 1770, 1780, and 1790 are embodiments of dies 540. Dies 1770 and 1790 may further function as an embodiment of holding dies 580. Pre-bending dies 1750 and 1760 are embodiments of pre-bending dies 550 and 560.

Mandrel 1710 has a surface 1712 that forms a closed loop around mandrel 1710. Surface 1710 has a triangular profile with rounded corners. Each of dies 1740 has a surface 1746 configured to impart a rounded ninety-degree bend on metal sheet 110 when mandrel 1710 forces metal sheet 110 against dies 1740. Surface 1712 has a minimum radius of curvature 1718 at each of its corners. Without departing from the scope hereof, dies 1740 may be a single, integrally formed piece with a pass-through for clamp 820, or dies 1740 may be rigidly connected to each other. In the embodiment depicted in FIG. 17, dies 1740 are configured to be stationary and mandrel 1710 is configured to be moveable toward dies 1740. However, in an alternative embodiment, mandrel 1710 is stationary and dies 1740 are moveable, or both mandrel 1710 and dies 1740 are moveable.

Pre-bending dies 1750 and 1760 are positioned to impart a bend to a distal segment of metal sheet 110 adjacent end face 114. Pre-bending die 1750 has a surface 1756, and pre-bending die 1760 has a surface 1766. Surfaces 1756 and 1766 match each other apart from being able to accommodate the thickness 212 of metal sheet 110 therebetween.

Dies 1770, 1780, and 1790 have respective surfaces 1776, 1786, and 1796. Each of surfaces 1776, 1786, and 1796 are configured to press metal sheet 110 against a corresponding portion of surface 1712.

In one embodiment, system 1700 further includes stop 830. Optionally, system 1700 includes weld head 870. Although for clarity not depicted in FIG. 17, system 1700 may further include an actuator for each of mandrel 1710, dies 1770, 1780, and 1790, and pre-bending dies 1750 and 1760.

FIGS. 17-21 together illustrate one method 1702 for manufacturing, from metal sheet 110, a ring having a triangular profile with rounded corners. Method 1702 utilizes system 1700. Each of FIGS. 17-21 shows, in cross-sectional side view, a different stage of method 1702. Method 1702 is an embodiment of method 700 that includes steps 734, 736, 738, and 739. Whereas methods 802 and 1402 applied pre-bending to both distal segments of metal sheet 110, method 1702 only pre-bends one of the distal ends. FIGS. 17-21 are best viewed together in the following description.

Referring first to FIG. 17, clamp 820 clamps a non-distal portion of metal sheet 110 against surface 1712 of mandrel 1710, in an embodiment of step 720. Prior to this step, metal sheet 110 may have been registered against stop 830, in an embodiment of step 710.

Figure 18:
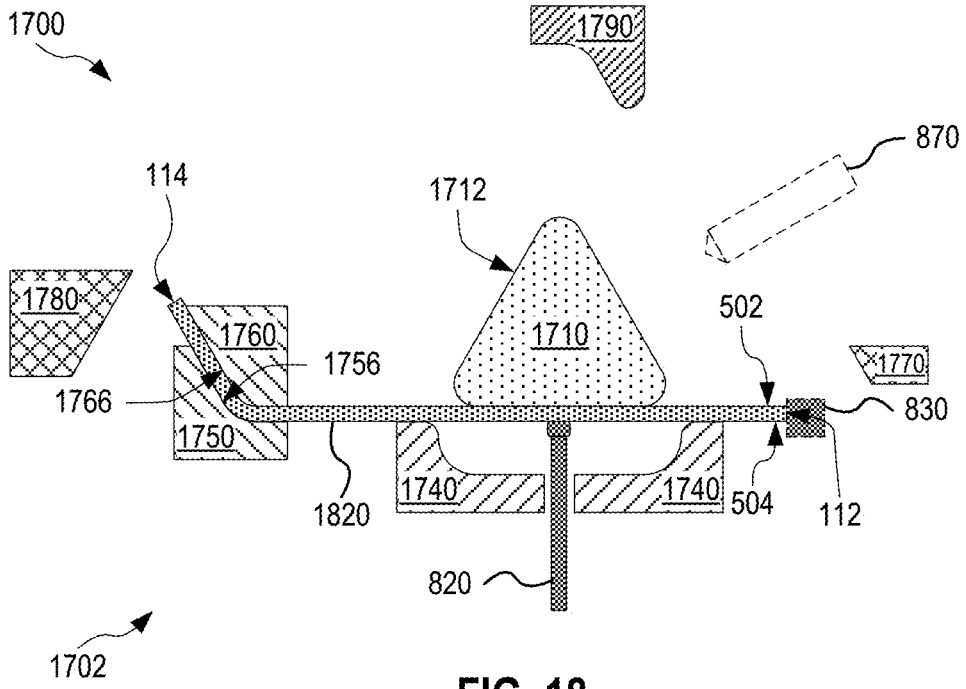

Next, as shown in FIG. 18, the distal end of metal sheet 110 adjacent end face 114 is pre-bent. Here, pre-bending dies 1750 and 1760 move toward each other from opposite sides of metal sheet 110 to bend the distal end between surfaces 1756 and 1766, in an embodiment of step 734. At this stage, metal sheet 110 has been bent into a workpiece 1820. The bend imparted by pre-bending dies 1750 and 1760 is, for example, in the range between 30 degrees and 90 degrees, in the range between 50 degrees and 70 degrees, or approximately 60 degrees.

Figure 19:
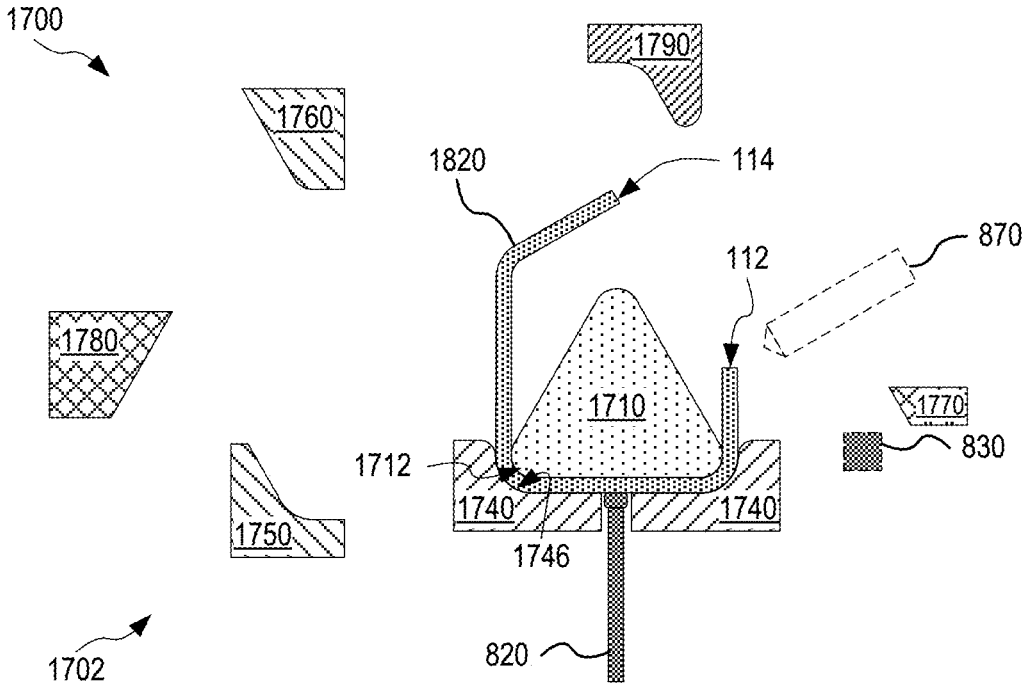
Figure 20:
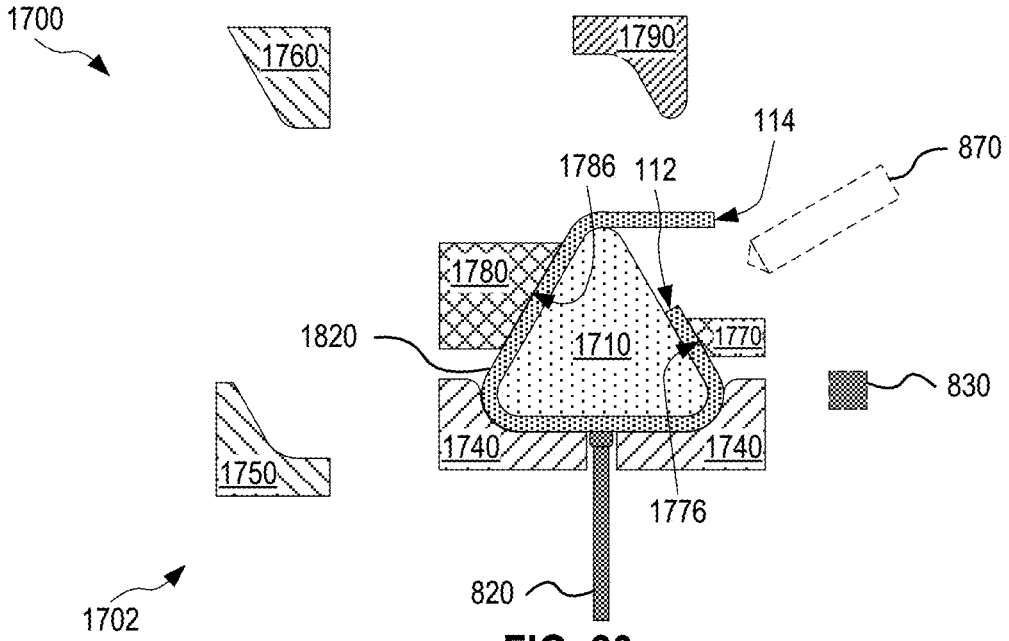

Following the pre-bending shown in FIG. 18, mandrel 1710 forces a portion of workpiece 1820 against surfaces 1746 of dies 1740, as shown in FIG. 19. This imparts a rounded ninety degree bend in two places on workpiece 1820. This step of method 1702 is a first portion of an embodiment of step 738. The bends imparted in FIG. 19 are the beginning of bending workpiece 1820 around two of the acute corners of mandrel 1710. However, additional bending is required to fully bend workpiece 1820 around the acute corners of mandrel 1710. FIG. 20 shows bending of workpiece 1820 to complete the bend around the two lower acute corners of mandrel 1710, in a next portion of an embodiment of step 738. Here, dies 1770 and 1780 force workpiece 1820 against two sides of surface 1712 to complete the bend of workpiece 1820 around the two lower acute corners of mandrel 1710.

Figure 21:
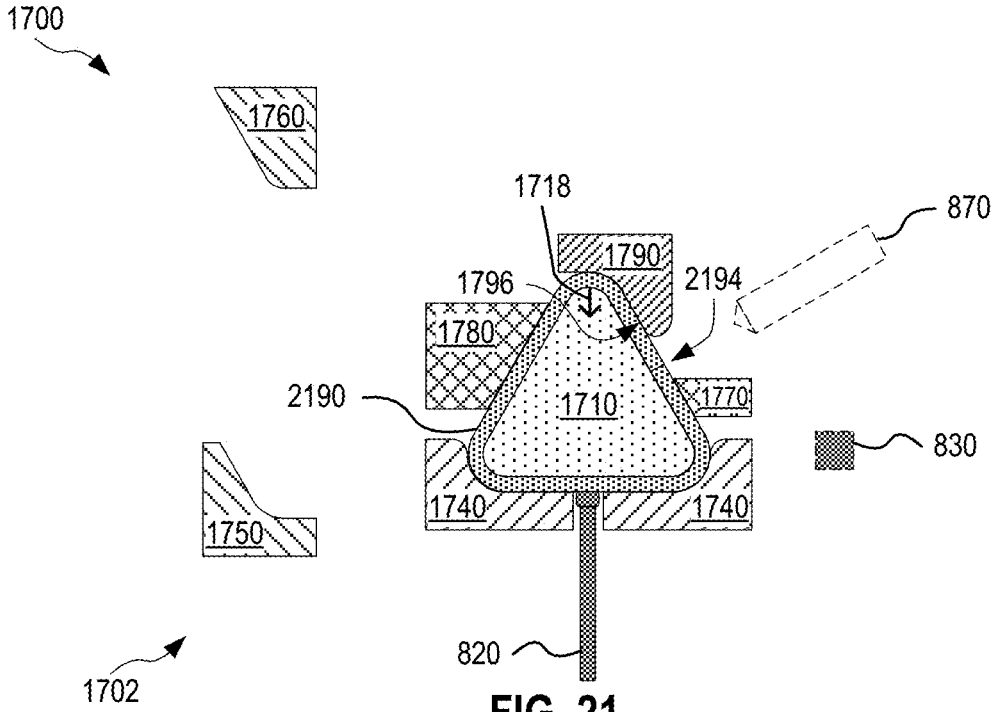

Finally, as shown in FIG. 21, in an embodiment of step 739, die 1790 completes the bend of workpiece 1820 around the top corner of mandrel 1710, so as to form a ring 2190 having a triangular profile with rounded corners. The radius of curvature of corners of ring 2190 is the same as radius of curvature 1718.

Method 1702 provides another example of the benefit of clamping metal sheet 110 to the mandrel, as discussed above in reference to method 802. Method 1702 also provides another example of benefits of registering metal sheet 110 against a stop, as discussed above in reference to method 1402. As also discussed above in reference to method 802 and system 800, method 1702 and system 1700 may utilize other functionality than stop 830 for properly positioning the center of metal sheet over clamp 820.

Method 1702 may further include welding joint 2194 between end faces 112 and 114, in a manner similar to that shown for method 802 in FIG. 12. During welding, dies 1770 and 1790 may act as holding dies.

Figure 22:
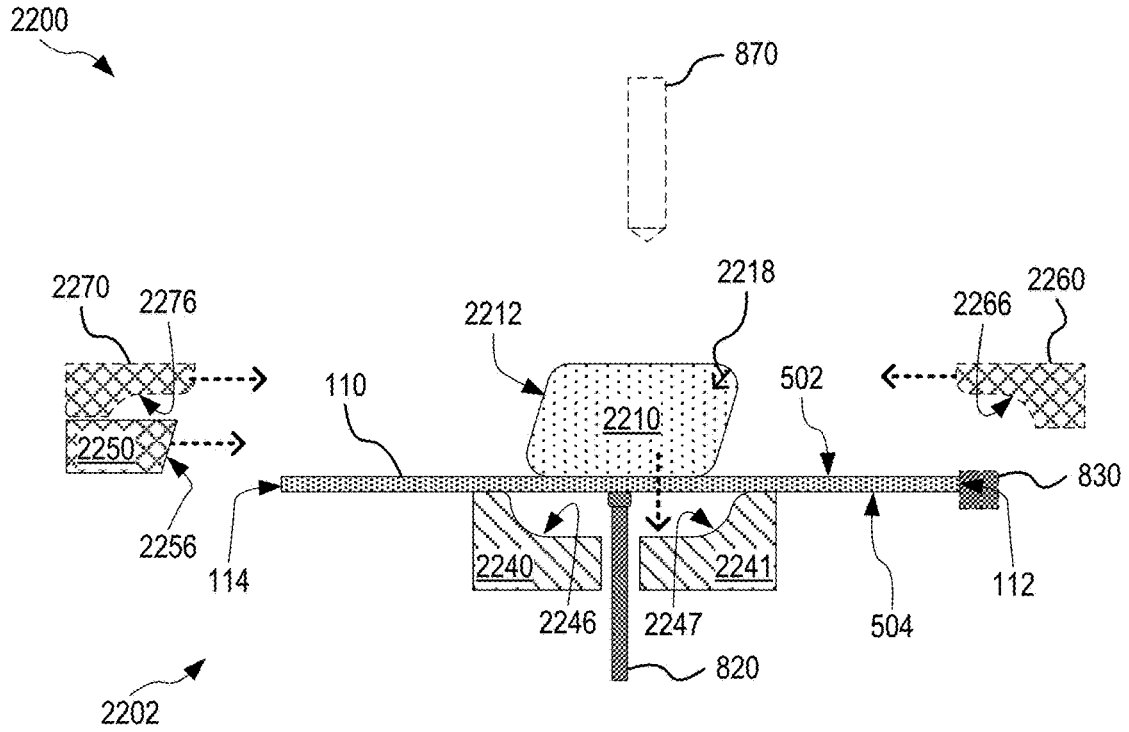
FIG. 22 illustrates a system for manufacturing a ring having a profile shaped as a parallelogram, according to an embodiment.

FIG. 22 illustrates, in cross-sectional side view, one system 2200 for manufacturing a ring, having a profile shaped like a parallelogram. System 2200 is an embodiment of system 500. System 2200 is configured to bend metal sheet 110 to form an embodiment of ring 190 that has a profile shaped like a parallelogram with rounded corners. System 2200 includes a mandrel 2210, clamp 820, a die 2240, a die 2241, and additional dies 2250, 2260, and 2270. Mandrel 2210 is an embodiment of mandrel 510. Dies 2240, 2241, 2250, 2260, and 2270 are embodiments of dies 540. Dies 2260 and 2270 may further function as an embodiment of holding dies 580.

Mandrel 2210 has a surface 2212 that forms a closed loop around mandrel 2210. The profile of surface 2212 is shaped as a parallelogram with rounded corners. Die 2240 has a surface 2246 configured to impart a rounded ninety-degree bend on metal sheet 110 when mandrel 2210 forces metal sheet 110 against dies 2240 and 2241. In this operation, die 2240 is aligned with an acute corner of mandrel 2210 and die 2241 is aligned with an oblique corner of mandrel 2210. Surface 2212 has a minimum radius of curvature 2218 at each of its two acute corners. Die 2241 has a surface 2247 configured to impart a rounded, oblique bend on metal sheet 110 when mandrel 2210 forces metal sheet 110 against dies 2240 and 2241.

Without departing from the scope hereof, dies 2240 and 2241 may be a single, integrally formed piece with a pass-through for clamp 820, or dies 2240 and 2241 may be rigidly connected to each other. In the embodiment depicted in FIG. 22, dies 2240 and 2241 are configured to be stationary and mandrel 2210 is configured to be moveable toward dies 2240 and 2241. However, in an alternative embodiment, mandrel 2210 is stationary and dies 2240 and 2241 moveable, or both mandrel 2210 and dies 2240 and 2241 are moveable.

Dies 2250, 2260, and 2270 have respective surfaces 2256, 2266, and 2276. Each of surfaces 2256, 2266, and 2276 are configured to press metal sheet 110 against a corresponding portion of surface 2212. In operation, die 2250 completes the bend of metal sheet 110 around the lower acute corner of mandrel 2210, and dies 2260 and 2270 bend metal sheet 110 around the upper corners of mandrel 2210.

In one embodiment, system 2200 further includes stop 830. Optionally, system 2200 includes weld head 870. Although for clarity not depicted in FIG. 22, system 2200 may further include an actuator for each of mandrel 2210 and dies 2250, 2260, and 2270.

FIGS. 22-25 together illustrate one method 2202 for manufacturing, from metal sheet 110, a ring having a profile shaped like a parallelogram with rounded corners. Method 2202 utilizes system 2200. Each of FIGS. 22-25 shows, in cross-sectional side view, a different stage of method 2202. Method 2202 is an embodiment of method 700 that includes steps 738, and 739, but does not require the pre-bending of step 734. FIGS. 22-25 are best viewed together in the following description.

Referring first to FIG. 22, clamp 820 clamps a non-distal portion (for example the center) of metal sheet 110 against surface 2212 of mandrel 2210, in an embodiment of step 720. Prior to this step, metal sheet 110 may have been registered against stop 830, in an embodiment of step 710.

Figure 23:
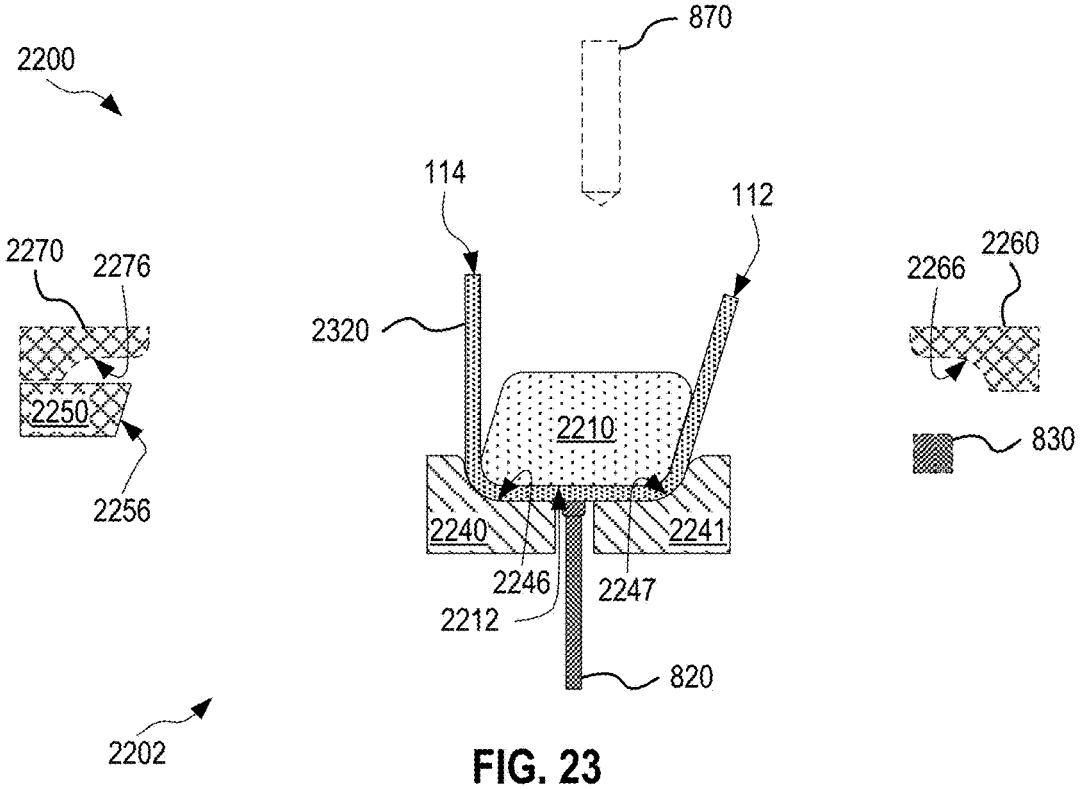

Next, as shown in FIG. 23, mandrel 2210 forces a portion of metal sheet 110 against surfaces 2246 and 2247 of dies 2240 and 2241. This step of method is a first portion of an embodiment of step 738 and forms a workpiece 2320 that has (a) a rounded ninety degree bend in at the lower acute corner of mandrel 2210 and (b) an oblique bend at the lower oblique corner of mandrel 2210. The bend imparted by die 2141, in cooperation with mandrel 2210, completes the bend of metal sheet 110 around the lower oblique corner of mandrel 2210.

Figure 24:
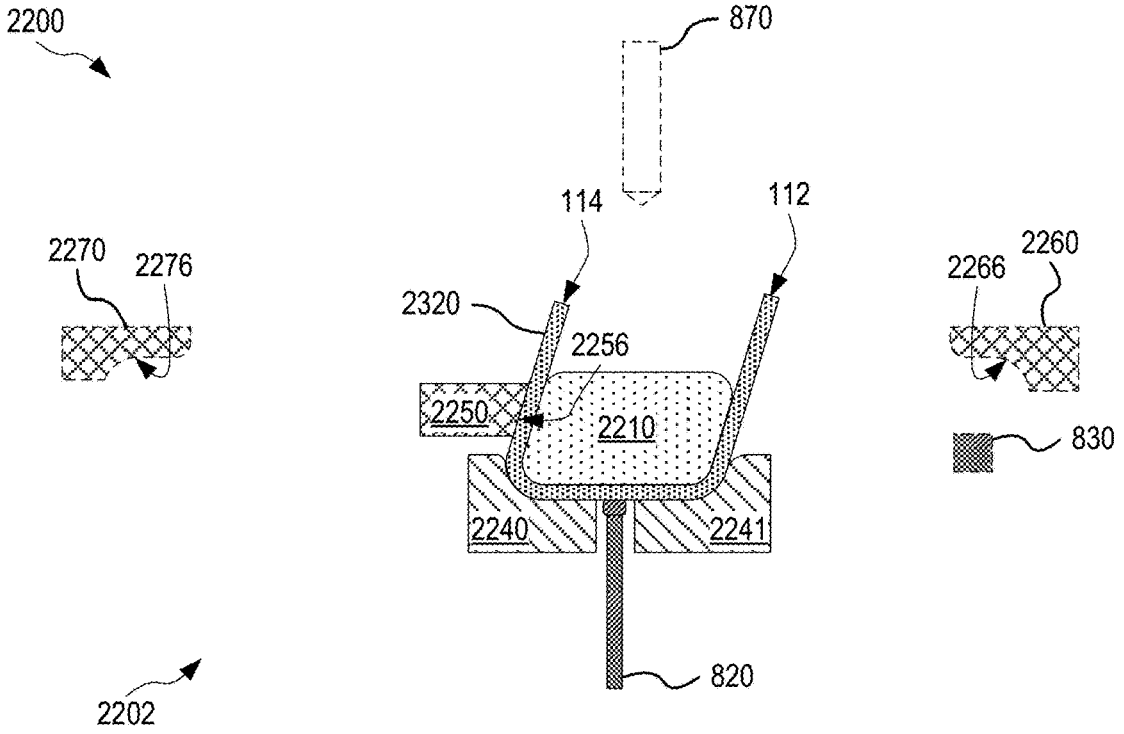

FIG. 24 shows a next step of method 2202, wherein die 2250 completes the bend of workpiece 2320 around the lower acute corner of mandrel 2210. This step is a next step in an embodiment of step 738.

Figure 25:
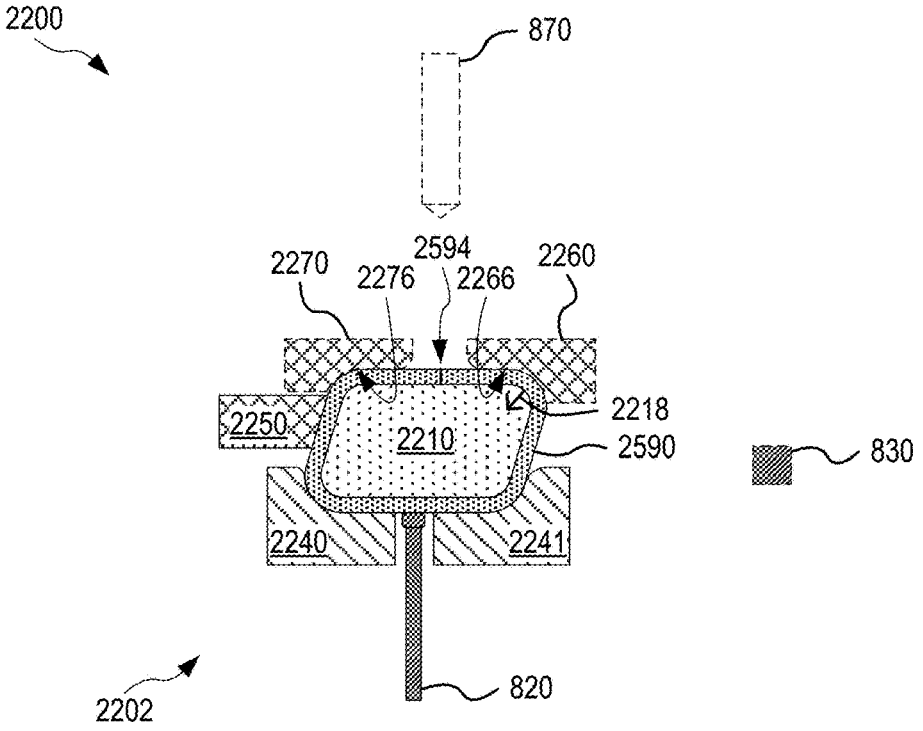

Finally, as shown in FIG. 25, in an embodiment of step 739, dies 2260 and 2270 bend workpiece 2320 around the top corners of mandrel 2210, so as to form a ring 2590 having a profile shaped like a parallelogram with rounded corners. The minimum radius of curvature of the acute corners of ring 2590 is the same as radius of curvature 2218.

Method 2202 provides yet another example of the benefit of clamping metal sheet 110 to the mandrel, as discussed above in reference to method 802. Method 2202 also provides yet another example of the benefit of registration metal sheet 110 against a stop, as discussed above in reference to method 1402. As also discussed above in reference to method 802 and system 800, method 2202 and system 2200 may utilize other functionality than stop 830 for properly positioning the center of metal sheet over clamp 820.

Method 2202 may further include welding joint 2594 between end faces 112 and 114, in a manner similar to that shown for method 802 in FIG. 12. During welding, dies 2260 and 2270 may act as holding dies.

Changes may be made in the above systems, methods, and workpieces without departing from the scope hereof. It should thus be noted that the matter contained in the above description and shown in the accompanying drawings should be interpreted as illustrative and not in a limiting sense. The following claims are intended to cover generic and specific features described herein, as well as all statements of the scope of the present systems and methods, which, as a matter of language, might be said to fall therebetween.

The invention claimed is:

1. A method for manufacturing a ring from a metal sheet, comprising:

extending a clamp along a first axis to push a center of the metal sheet against a cylindrical mandrel, the first axis lying within a two-dimensional plane that is perpendicular to a cylindrical axis of the cylindrical mandrel;

while the clamp holds the metal sheet against the cylindrical mandrel:

moving one or both of a first pair of pre-bending dies toward each other to bend a first distal segment of the metal sheet, the one or both of the first pair of pre-bending dies moving along a second axis that is parallel to the first axis and that lies within the two-dimensional plane;

moving one or both of a second pair of pre-bending dies toward each other to bend a second distal segment of the metal sheet, the one or both of the second pair of pre-bending dies moving along a third axis that is parallel to the first axis and that lies within the two-dimensional plane; and extending one or more central dies toward the cylindrical mandrel to bend a central segment of the metal sheet around the cylindrical mandrel, the one or more central dies extending along a fourth axis that is parallel to the first axis and that lies within the two-dimensional plane; and while the cylindrical mandrel is stationary and the one or more central dies hold the central segment of the metal sheet against the cylindrical mandrel:

translating first and second holding dies towards each other such that the first and second holding dies push the first and second distal segments against the cylindrical mandrel to form a joint therebetween, the first and second holding dies moving along a fifth axis that is perpendicular to the first axis and that lies within the two-dimensional plane; and welding the joint while the first and second holding dies hold the first and second distal segments against the cylindrical mandrel.

2. The method of claim 1, wherein said extending the one or more central dies is performed at a temperature no greater than 40 degrees Celsius.

3. The method of claim 1, wherein said extending the one or more central dies is performed at a temperature no less than 25 degrees Celsius.

4. The method of claim 1, further comprising:

registering, prior to said extending the clamp, the metal sheet against a stop; and maintaining, during said extending the clamp, registration of the metal sheet against the stop.

5. The method of claim 1, wherein:

the clamp holds the metal sheet against the cylindrical mandrel at a first azimuthal location of the cylindrical mandrel; and the joint occurs at a second azimuthal location of the cylindrical mandrel that is opposite the first azimuthal location.

6. The method of claim 1, wherein the cylindrical mandrel is stationary.

7. The method of claim 1, wherein:

the first pair of pre-bending dies bend the first distal segment to form a first quarter-cylindrical wall of the ring; and the second pair of pre-bending dies bend the second distal segment to form a second quarter-cylindrical wall of the ring.

8. The method of claim 1, wherein the one or more central dies bend the central segment to form a semi-cylindrical wall of the ring.

9. The method of claim 1, wherein a size of the joint is no more than 0.02 inches.

10. The method of claim 1, further comprising cutting the metal sheet from a metal stock such that a distance between opposing first and second end faces of the metal sheet exceeds a circumference of the cylindrical mandrel by no more than 0.02 inches.

11. The method of claim 1, wherein:

a thickness of the metal sheet is between 0.125 inches and 1.0 inches; and a minimum radius of curvature of the ring is no greater than 15 inches.

12. The method of claim 1, wherein the first and second holding dies contact the respective first and second distal segments along a surface having a radius of curvature similar to that of the cylindrical mandrel.

13. The method of claim 12, wherein the first and second holding dies, when holding the first and second distal segments against the cylindrical mandrel, form an opening through which a weld head may pass to contact the joint.

14. The method of claim 1, further comprising:

retracting, after said moving the first pair of pre-bending dies, one or both of the first pair of pre-bending dies along the second axis and away from each other; and retracting, after said moving the second pair of pre-bending dies, one or both of the second pair of pre-bending dies along the third axis and away from each other.

15. A method for manufacturing a ring from a metal sheet, comprising:

extending a clamp along a first axis to push a center of the metal sheet against a cylindrical mandrel, the first axis lying within a two-dimensional plane that is perpendicular to a cylindrical axis of the cylindrical mandrel;

while the clamp holds the metal sheet against the cylindrical mandrel:

moving one or both of a first pair of pre-bending dies toward each other to bend a first distal segment of the metal sheet, the one or both of the first pair of pre-bending dies moving along a second axis that is parallel to the first axis and that lies within the two-dimensional plane;

moving one or both of a second pair of pre-bending dies toward each other to bend a second distal segment of the metal sheet, the one or both of the second pair of pre-bending dies moving along a third axis that is parallel to the first axis and that lies within the two-dimensional plane; and extending the cylindrical mandrel toward one or more central dies to bend a central segment of the metal sheet around the cylindrical mandrel, the cylindrical mandrel extending along a fourth axis that is parallel to the first axis and that lies within the two-dimensional plane; and while the cylindrical mandrel is stationary and the one or more central dies hold the central segment of the metal sheet against the cylindrical mandrel:

translating first and second holding dies towards each other such that the first and second holding dies push the first and second distal segments against the cylindrical mandrel to form a joint therebetween, the first and second holding dies moving along a fifth axis that is perpendicular to the first axis and that lies within the two-dimensional plane; and welding the joint while the first and second holding dies hold the first and second distal segments against the cylindrical mandrel.

16. The method of claim 15, wherein the one or more central dies are stationary.

17. The method of claim 15, wherein:

the first pair of pre-bending dies bend the first distal segment to form a first quarter-cylindrical wall of the ring; and the second pair of pre-bending dies bend the second distal segment to form a second quarter-cylindrical wall of the ring.

18. The method of claim 15, further comprising:

registering, prior to said extending the clamp, the metal sheet against a stop; and maintaining, during said extending the clamp, registration of the metal sheet against the stop.

19. The method of claim 15, wherein:

the clamp holds the metal sheet against the cylindrical mandrel at a first azimuthal location of the cylindrical mandrel; and the joint occurs at a second azimuthal location of the cylindrical mandrel that is opposite the first azimuthal location.

20. The method of claim 15, wherein the first and second holding dies, when holding the first and second distal segments against the cylindrical mandrel, form an opening through which a weld head may pass to contact the joint.

* * * * *